US006336024B1

(12) United States Patent
Kanaya et al.

(10) Patent No.: US 6,336,024 B1
(45) Date of Patent: Jan. 1, 2002

(54) IMAGE FORMING APPARATUS CAPABLE OF REDUCING COLOR MISREGISTRATION

(75) Inventors: Shinichi Kanaya; Junichi Murakami, both of Ebina (JP)

(73) Assignee: Fuji Xerox, Co., Ltd., Tokyo (JP)

( * ) Notice: Subject to any disclaimer, the term of this patent is extended or adjusted under 35 U.S.C. 154(b) by 0 days.

(21) Appl. No.: 09/499,643

(22) Filed: Feb. 8, 2000

(30) Foreign Application Priority Data

Feb. 9, 1999 (JP) ..... 11-031879
Sep. 27, 1999 (JP) ..... 11-272621

(51) Int. Cl.[7] ..... G03G 15/01
(52) U.S. Cl. ..... 399/301; 347/116; 347/234
(58) Field of Search ..... 347/115, 116, 347/119, 234, 235, 248, 249, 250; 399/167, 301, 302

(56) References Cited

U.S. PATENT DOCUMENTS

| | | | | | |
|---|---|---|---|---|---|
| 5,083,140 | A | * | 1/1992 | Peterson et al. | 347/248 |
| 5,164,783 | A | * | 11/1992 | Taguchi et al. | 399/301 |
| 5,233,402 | A | * | 8/1993 | Yagi et al. | 347/116 X |
| 5,305,023 | A | * | 4/1994 | Fukushige et al. | 347/116 |
| 5,602,578 | A | * | 2/1997 | Sumiyoshi et al. | 347/232 |
| 5,631,691 | A | * | 5/1997 | Furuta et al. | 347/235 |
| 5,765,083 | A | * | 6/1998 | Shinohara | 399/301 |
| 5,821,970 | A | * | 10/1998 | Sasaki et al. | 347/115 |
| 6,075,547 | A | * | 6/2000 | Takeuchi | 347/116 |

FOREIGN PATENT DOCUMENTS

| | | | |
|---|---|---|---|
| JP | A-4-234064 | | 8/1992 |
| JP | 6-222636 | * | 8/1994 |
| JP | 6-258897 | * | 9/1994 |
| JP | 7-43970 | * | 2/1995 |
| JP | 8-220832 | * | 8/1996 |
| JP | 8-220967 | * | 8/1996 |
| JP | 8-224912 | * | 9/1996 |
| JP | 9-127847 | * | 9/1996 |
| JP | A-9-80853 | | 3/1997 |
| JP | 9-175687 | | 7/1997 |
| JP | 9-182488 | * | 7/1997 |
| JP | 9-274396 | * | 10/1997 |
| JP | 10-133448 | * | 5/1998 |

* cited by examiner

*Primary Examiner*—Joan Pendegrass
(74) *Attorney, Agent, or Firm*—Oliff & Berridge PLC

(57) ABSTRACT

An image forming apparatus which reduces a color misregistration caused by a variation in speed of a photoconductor or an intermediate transfer medium. The image forming apparatus is constructed to superimpose multiple color images on each other on an intermediate transfer medium by rotating a photoconductor and the intermediate transfer medium and to form a color image. In the image forming apparatus, detection is made as to the phase difference between the timing of forming a latent image on the photoconductor and the rotational speed of the intermediate transfer medium, and the detected phase difference is corrected by increasing or decreasing the rotational speed of the intermediate transfer medium by using a correction signal, while no latent image is being transferred to the intermediate transfer medium. In addition, a transfer misregistration caused by a variation in load acting on the intermediate transfer medium is corrected by adding the transfer misregistration to a correction signal.

16 Claims, 15 Drawing Sheets

VIEW SHOWING TIMING OF IMAGE FORMATION

GRAPH SHOWING CORRECTION OF POSITION OF LEADING EDGE OF IMAGE

GRAPH SHOWING MISREGISTRATION AMOUNT OF TRANSFER POSITION IN IMAGE-FORMED PORTION (CASE WHERE LOAD VARIATION OCCURS DURING PRIMARY TRANSFER OF K COLOR)

GRAPH SHOWING MISREGISTRATION AMOUNT OF TRANSFER POSITION AFTER CORRECTION

GRAPH SHOWING MISREGISTRATION AMOUNT OF TRANSFER POSITION IN IMAGE-FORMED PORTION (CASE WHERE LOAD VARIATION OCCURS BEFORE WRITING OF Y COLOR LATENT IMAGE)

GRAPH SHOWING STATE IN WHICH AVERAGE SPEED VARIES DUE TO INCREASE IN LOAD

GRAPH SHOWING STATE IN WHICH PRINT POSITION GRADUALLY DEVIATES DUE TO DIFFERENCE IN AVERAGE SPEED

GRAPH SHOWING STATE IN WHICH AVERAGE SPEED TEMPORARILY DECREASES DUE TO INCREASE IN LOAD

GRAPH SHOWING MISREGISTRATION WHICH OCCURS DUE TO TEMPORARY DECREASE IN SPEED

IMAGE FORMING APPARATUS CAPABLE OF REDUCING COLOR MISREGISTRATION

BACKGROUND OF THE INVENTION

1. Filed of the Invention

The present invention relates to an image forming apparatus and, more particularly, to an image forming apparatus capable of reducing, without using a special mechanism, a color misregistration caused by a variation in the load of a belt-shaped intermediate transfer medium or a belt-shaped photoconductor.

2. Description of the Related Art

A color image forming apparatus which uses a belt-shaped intermediate transfer medium or a belt-shaped photoconductor as an image carrier has heretofore been known as a xerographic printer. In a color image forming apparatus which uses a belt-shaped intermediate transfer medium, a latent image of a first color is formed by scanning the surface of a photoconductor with a laser beam, and the latent image is developed to form toner image of the first color and this toner image is transferred to the intermediate transfer medium. Then, a latent image of a second color is formed on the surface of the photoconductor and a toner image of the second color is formed, and this toner image is superimposed on and transferred to the toner image of the first color on the intermediate transfer medium. In this manner, toner images of individual colors Y (yellow), M (magenta), C (cyan) and K (black) are formed on the surface of the intermediate transfer medium in a superimposed state, and the color toner images formed on the intermediate transfer medium are collectively transferred to a recording sheet which is an image carrier.

In a color image forming apparatus which uses a belt-shaped photoconductor, a latent image of a first color is formed by scanning the surface of a photoconductor with a laser beam, and the latent image is developed to form a toner image of the first color. Then, a latent image of a second color is formed on the surface of the photoconductor and a toner image of the second color is formed. In this manner, toner images of plural colors are formed on the surface of the photoconductor in a superimposed state, and the color toner images formed on the photoconductor are collectively transferred to a recording sheet which is an image carrier.

In such a color image forming apparatus, a variation in the speed of the intermediate transfer medium or the photoconductor which is a belt-shaped image carrier causes a variation in the print position of each of the color toner images, resulting in color misregistration or non-uniform density. In general, a variation in the speed of the belt is a periodic variation due to the eccentricity of a belt driving roll, but a variation in speed due to a variation in load acting on the belt is also a large problem. FIG. 13 is a graph showing the relationship between a load acting on the belt-shaped image carrier and the average speed of the belt-shaped image carrier. When the load acting on the belt is small, a small slip or elongation occurs in the belt, and the average speed of the belt linearly decreases with an increase in the load. On the other hand, if the load acting on the belt is a predetermined or more, a slip occurs and it becomes impossible to transport the belt, so that the speed of the belt linearly decreases. In a region in which the average speed linearly varies, if the load increases, the average speed of the belt decreases from V to V' as shown in FIG. 14A. In the case of printing at the average speed V', since the average speed V' is lower than the average speed V, color misregistrations accumulate while the load is increasing, and even if the leading edges of transfer positions of toner images coincide with one another in the sub-scan direction, a color misregistration amount R occurs as shown in FIG. 14B.

On the other hand, a decrease in speed due to the flexure of a driving system such as a driving gear which drives a belt driving roll is different from an average decrease in speed due to a slip or an elongation of the belt, and as shown in FIG. 15A, when a load is applied, the speed instantaneously decreases and is immediately restored. Accordingly, as shown in FIG. 15B, only when a load is applied, a misregistration of a print position instantaneously occurs, and after that no misregistration occurs so that, the misregistration quantities of print positions do not accumulate.

In other words, when a transfer roll or a cleaner to be used during transfer to the belt-shaped intermediate transfer medium makes contact with the belt-shaped intermediate transfer medium, a difference occurs between the speeds of the belt-shaped intermediate transfer medium before and after the transfer roll or the cleaner makes contact with the same, and the difference in speed causes small variations in print position, thus causing a color misregistration of a print position.

The problem of the transfer misregistration also occurs in the case of a drum-shaped photoconductor or intermediate transfer medium.

A general method for ameliorating such small variations in print position is to detect a variation in the speed or the position of a belt-shaped image carrier and correct a print position. Japanese Patent Laid-Open No. 234064/1992 discloses the art of securing an encoder to a roll shaft to be driven by a belt-shaped image carrier and detecting the speed of the belt-shaped image carrier from an angular velocity obtained from the encoder. Japanese Patent Laid-Open No. 175687/1997 describes the art of printing a mark on a belt-shaped image carrier in advance and detecting the mark through a sensor to detect and control the speed of the belt-shaped imager carrier.

However, either of these arts is suited to the art of controlling the speed of a belt-shaped image carrier with high precision, but needs devices such as a detecting device which detects the speed of the image carrier, a computing device which computes a correction amount relative to the detected speed, and a control device which controls a belt driving speed on the basis of the computed result. Either of the arts has, therefore, the problem that the entire size of the image forming apparatus becomes so large as to be disadvantageous in terms of cost and space.

Japanese Patent Laid-Open No. 80853/1997 describes a color image forming apparatus in which a photoconductor and the intermediate transfer medium are driven independently of each other. The color image forming apparatus utilizes an art for correcting a color misregistration due to the fact that a latent image writing part and an intermediate transfer medium are asynchronous with each other. In the art, the phase difference between the rotational period of the latent image writing part and the rotational period of the intermediate transfer medium is detected on the basis of a reference position signal relative to the intermediate transfer medium, and if a color misregistration occurs when a toner image formed on the photoconductor is superimposed on a toner image previously transferred to the intermediate transfer medium, the rotational speed of the intermediate transfer medium is increased or decreased while a toner image is not being transferred to the intermediate transfer medium, thereby correcting the phase difference. Japanese Patent Laid-Open No. 80853/1997 also describes the art of, when a latent image is not being written to the photoconductor, increasing or decreasing the rotational period of the intermediate transfer medium and correcting the phase difference in order to correct a color misregistration occurring in case that the photoconductor and the intermediate transfer medium are driven by identical or different driving devices.

However, the art of Japanese Patent Laid-Open No. 80853/1997 has the problem that since the phase difference is detected on the basis of the reference position signal, a color misregistration or a density deviation cannot be corrected if a variation in load occurs in the intermediate transfer medium or the photoconductor after the reference position signal has been outputted.

SUMMARY OF THE INVENTION

The invention has been made to solve the above-described problems, and provide an image forming apparatus capable of reducing a color misregistration due to a variation in the speed of an image carrier such as a photoconductor or an intermediate transfer medium without the need to incorporate a device which detects a variation in the speed of the intermediate transfer medium or the like.

According to a first aspect of the invention, an image forming apparatus superimposes multiple color images on each other on an intermediate transfer medium by rotating a photoconductor and the intermediate transfer medium by using a driving source using an identical driving signal to form a color image, and includes a misregistration correcting part which, when each of the multiple color images is to be transferred to the intermediate transfer medium, increases or decreases a rotational speed of the intermediate transfer medium while no latent image is being formed on the photoconductor to correct a transfer misregistration caused by a variation in load acting on the intermediate transfer medium.

According to the above aspect of the invention, the photoconductor and the intermediate transfer medium are rotated by a driving source using an identical driving signal by driving the photoconductor and the intermediate transfer medium by an identical driving source or by driving the photoconductor and the intermediate transfer medium by different driving sources using an identical driving signal. In the above aspect of the invention, the transfer misregistration is corrected by increasing or decreasing the rotational speed of the intermediate transfer medium while no latent image is being formed on the photoconductor, whereby the respective rotational speeds of the photoconductor and the intermediate transfer medium vary similarly and a difference in speed hardly occurs between the photoconductor and the intermediate transfer medium. Accordingly, even if the rotational speed of the intermediate transfer medium is changed during transfer, a toner image to be transferred is hardly affected.

According to a second aspect of the invention, an image forming apparatus superimposes multiple color images on each other on an intermediate transfer medium by rotating a photoconductor and the intermediate transfer medium by using a driving source using different driving signals to form a color image, and includes a misregistration correcting part which, when each of the multiple color images is to be transferred to the intermediate transfer medium, increases or decreases a rotational speed of the intermediate transfer medium while no image is being transferred to the intermediate transfer medium to correct a transfer misregistration caused by a variation in load acting on the intermediate transfer medium.

According to the above aspect of the invention, the transfer misregistration is corrected by increasing or decreasing the rotational speed of the intermediate transfer medium while no image is being transferred to the intermediate transfer medium, whereby an image to be transferred is not affected. In addition, according to the above aspect of the invention, the photoconductor and the intermediate transfer medium are rotated by using a driving source using different driving signals, whereby even if the rotational speed of the intermediate transfer medium is changed, the rotational period of the photoconductor is hardly affected. Accordingly, even if the rotational speed of the intermediate transfer medium is changed during forming of a latent image, a latent image to be formed on the photoconductor is hardly affected.

According to a third aspect of the invention, an image forming apparatus superimposes multiple color images on each other on an intermediate transfer medium and forms a color image, by rotating a photoconductor and the intermediate transfer medium by using a driving source using identical or different driving signals, and includes a misregistration correcting part which corrects a transfer misregistration caused by a variation in load acting on the intermediate transfer medium, by increasing or decreasing a rotational speed of a light scan device which forms a latent image on the photoconductor, while no latent image is being formed on the photoconductor.

According to the above aspect of the invention, the transfer misregistration is corrected by increasing or decreasing, while no latent image is being formed on the photoconductor, the rotational speed of the light scan device which forms a latent image on the photoconductor by a rotary polygon mirror, whereby an image to be transferred is not affected.

According to a fourth aspect of the invention, an image forming apparatus superimposes multiple color images on each other on an intermediate transfer medium and forms a color image, by rotating a photoconductor and the intermediate transfer medium by using a driving source using identical or different driving signals, and includes a misregistration correcting part which corrects a transfer misregistration caused by a variation in load acting on the intermediate transfer medium, by changing an on-off timing of a light emitting element array which forms a latent image on the photoconductor, while no latent image is being formed on the photoconductor.

According to the above aspect of the invention, the transfer misregistration is corrected by changing, while no latent image is being formed on the photoconductor, the ON timing of the light emitting element array which forms a latent image on the photoconductor by using an LED array and the like, whereby an image to be transferred is not affected.

According to a fifth aspect of the invention, an image forming apparatus superimposes multiple color images on each other on an intermediate transfer medium and forms a color image, by rotating a photoconductor and the intermediate transfer medium by using a driving source using an identical driving signal, and includes a detecting part which detects a phase difference between a timing of forming a latent image on the photoconductor and a rotational speed of the intermediate transfer medium, a phase correcting part which corrects the phase difference by increasing or decreasing a rotational speed of the intermediate transfer medium on the basis of a detection result provided by the detecting part, while no latent image is being formed on the photoconductor, and a misregistration correcting part which corrects, by using the phase correcting part, a transfer misregistration caused by a variation in load acting on the intermediate transfer medium, when each of the multiple color images is to be formed on the intermediate transfer medium.

According to the above aspect of the invention, the photoconductor and the intermediate transfer medium are rotated by a driving source using an identical driving signal, by driving the photoconductor and the intermediate transfer medium by an identical driving source or by driving the photoconductor and the intermediate transfer medium by different driving sources using an identical driving signal. In the above aspect of the invention, the transfer misregistration is corrected by increasing or decreasing the rotational speed of the intermediate transfer medium while no latent image is being formed on the photoconductor, by using the phase correcting part which corrects the phase difference between the timing of forming a latent image on the photoconductor and the rotational period of the intermediate transfer medium. Accordingly, the respective rotational speeds of the photoconductor and the intermediate transfer medium vary similarly and a difference in speed hardly occurs between the photoconductor and the intermediate transfer medium. Accordingly, even if the rotational speed of the intermediate transfer medium is changed during transfer, a toner image to be transferred is hardly affected.

According to a sixth aspect of the invention, an image forming apparatus superimposes multiple color images on each other on an intermediate transfer medium and forms a color image, by rotating a photoconductor and the intermediate transfer medium by using a driving source using different driving signals, and includes a detecting part which detects a phase difference between a timing of forming a latent image on the photoconductor and a rotational speed of the intermediate transfer medium, a phase correcting part which corrects the phase difference by increasing or decreasing a rotational speed of the intermediate transfer medium on the basis of a detection result provided by the detecting part, while no image is being transferred to the intermediate transfer, and a misregistration correcting part which corrects, by using the phase correcting part, a transfer misregistration caused by a variation in load acting on the intermediate transfer medium, when each of the multiple color images is to be transferred to the intermediate transfer medium.

According to the above aspect of the invention, the transfer misregistration is corrected by increasing or decreasing the rotational speed of the intermediate transfer medium while no image is being transferred to the intermediate transfer medium, whereby an image to be transferred to is not affected. In addition, according to the above aspect of the invention, the photoconductor and the intermediate transfer medium are rotated by using a driving source using different driving signals, whereby even if the rotational speed of the intermediate transfer medium is changed, the rotational period of the photoconductor is hardly affected. Accordingly, even if the rotational speed of the intermediate transfer medium is changed during forming of a latent image, a latent image to be formed on the photoconductor is hardly affected.

According to a seventh aspect of the invention, an image forming apparatus superimposes multiple color images on each other on an intermediate transfer medium and forms a color image, by rotating a photoconductor and the intermediate transfer medium by using a driving source using identical or different driving signals, as well as by rotating a latent image forming part, and includes a detecting part which detects a phase difference between a timing of forming a latent image on the photoconductor and a rotational speed of the intermediate transfer medium, a phase correcting part which corrects the phase difference by increasing or decreasing a rotational speed of the latent image forming part on the basis of a detection result provided by the detecting part, while no latent image is being formed on the photoconductor, and a misregistration correcting part which corrects, by using the phase correcting part, a transfer misregistration caused by a variation in load acting on the intermediate transfer medium, when each of the multiple color images is to be transferred to the intermediate transfer medium.

According to the above aspect of the invention, the transfer misregistration is corrected by increasing or decreasing, while no latent image is being formed on the photoconductor, the rotational speed of the latent image forming part, whereby an image to be transferred is not affected.

As to a thirteenth aspect of the invention, according to any one of the first seventh aspects of the invention, the transfer misregistration caused by the variation in load acting on the intermediate transfer medium is calculated from a difference between the rotational period of the intermediate transfer medium when a variation in load is applied thereto and the rotational period of the intermediate transfer medium when no variation in load is applied thereto.

According to an eighth aspect of the invention, an image forming apparatus superimposes multiple color images on each other on a photoconductor and forms a color image, by rotating the photoconductor, and includes a misregistration correcting part which, when a latent image of each of the multiple color images is to be formed on the photoconductor, increases or decreases a rotational speed of the photoconductor while no latent image is being formed on the photoconductor to correct a latent image forming misregistration caused by a variation in load acting on the photoconductor.

According to a ninth aspect of the invention, the eighth aspect of the invention uses a light scan device which forms a latent image on the photoconductor, and a latent image forming misregistration is corrected by increasing or decreasing the rotational speed of the light scan device instead of the rotational speed of the photoconductor. According to a tenth aspect of the invention, the eighth aspect of the invention uses a light emitting element array which forms a latent image on the photoconductor, and a latent image forming misregistration is corrected by changing the on-off timing of the light emitting element array instead of increasing or decreasing the rotational speed of the photoconductor.

According to an eleventh aspect of the invention, an image forming apparatus superimposes multiple color images on each other on a photoconductor and forms a color image, by rotating the photoconductor, includes a detecting part which detects a phase difference between a timing of forming a latent image on the photoconductor and a rotational speed of the photoconductor, a phase correcting part which corrects the phase difference by increasing or decreasing a rotational speed of the photoconductor on the basis of a detection result provided by the detecting part, while no latent image is being formed on the photoconductor, and a misregistration correcting part which corrects, by using the phase correcting part, a latent image forming misregistration caused by a variation in load acting on the photoconductor, when a latent image of each of the multiple color images is to be formed on the photoconductor.

According to a twelfth aspect of the invention, a latent image forming misregistration is corrected by increasing or decreasing the rotational speed of a latent image forming part instead of the rotational speed of the photoconductor used in the above aspect.

According to the eighth to twelfth aspects of the invention, the transfer misregistration is corrected by correcting, while no latent image is being formed on the photoconductor, the latent image forming misregistration by increasing or decreasing the rotational speed of the photoconductor or the light scan device or by changing the on-off timing of the light emitting element array, whereby an image to be transferred is not affected.

According to a fourteenth aspect of the invention, in each of the eighth to twelfth aspects of the invention, the latent image forming misregistration caused by the variation in load acting on the photoconductor is calculated from a difference between the rotational period of the photoconductor when a variation in load is applied thereto and the rotational period of the photoconductor when no variation in load is applied thereto.

According to another aspect of the invention, an image forming apparatus superimposes multiple color images on each other on an intermediate transfer medium and forms a color image, by rotating a photoconductor and the intermediate transfer medium by using a driving source using identical or different driving signals, and includes a part which calculates a transfer misregistration caused by a variation in load acting on the intermediate transfer medium from a difference between a rotational period of the intermediate transfer medium when a variation in load is applied thereto and a rotational period of the intermediate transfer medium when no variation in load is applied thereto, and a misregistration correcting part which corrects the transfer misregistration on the basis of a calculation result provided by the part.

According to another aspect of the invention, an image forming apparatus superimposes multiple color images on each other on a photoconductor and forms a color image, by rotating the photoconductor, and includes a part which calculates a latent image forming misregistration caused by a variation in load acting on the photoconductor from a difference between a rotational period of the photoconductor when a variation in load is applied thereto and a rotational period of the photoconductor when no variation in load is applied thereto, and a correcting part which corrects the latent image forming misregistration on the basis of a calculation result provided by the part.

BRIEF DESCRIPTION OF THE DRAWINGS

Preferred embodiments of the invention will be described in detail based on the following figures, wherein.

DETAILED DESCRIPTION OF THE INVENTION

Figure 1:
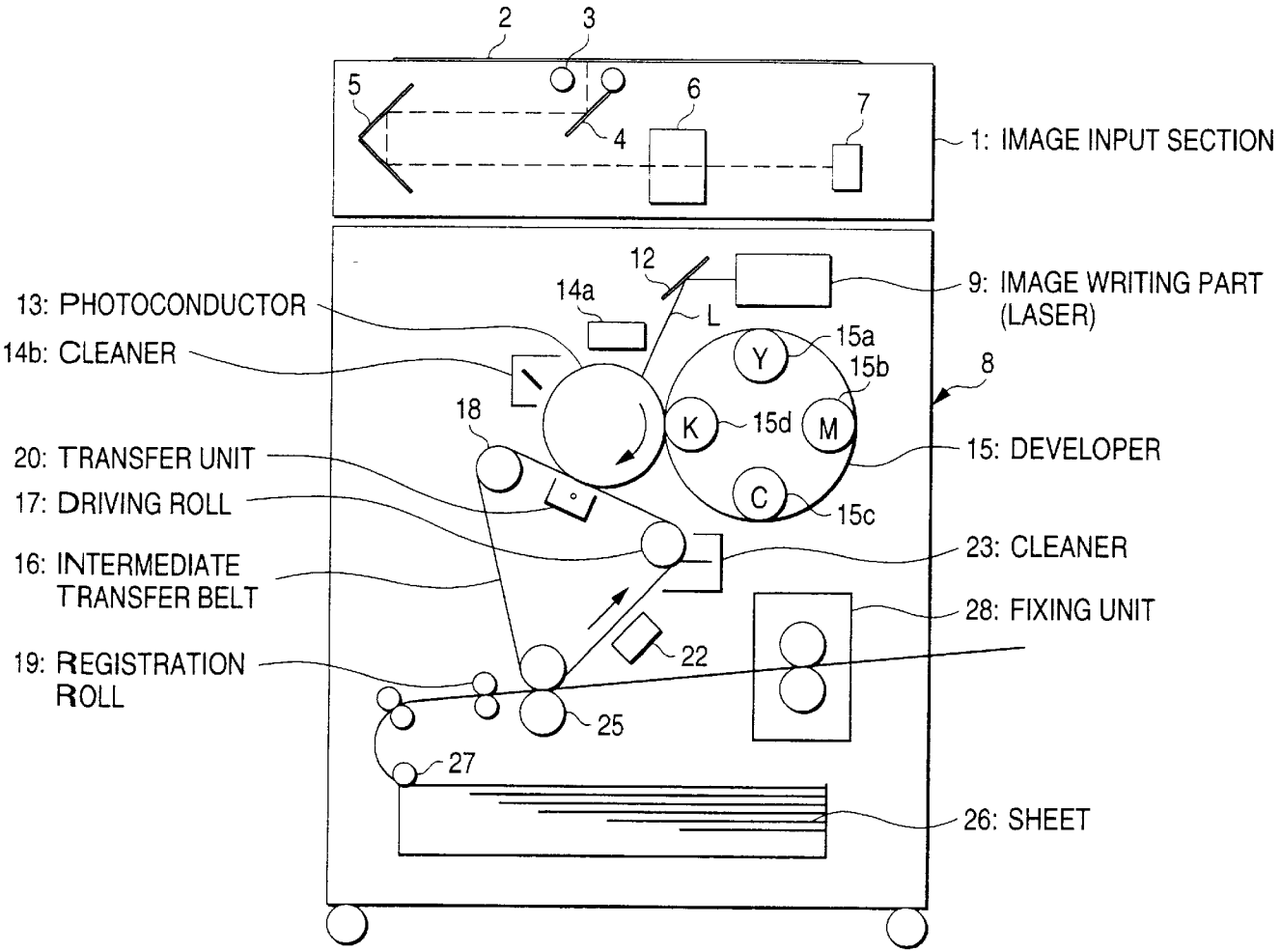
FIG. 1 is a cross-sectional side view showing a color image forming apparatus according to a first embodiment of the invention.

A first embodiment of the invention will be described below with reference to the accompanying drawings. As shown in FIG. 1, a color image forming apparatus according to the first embodiment includes an image input section 1 which reads a document and outputs an image signal, and an image output section 8 which forms an image on a sheet on the basis of the image signal. In the image input section 1, a document (not shown) placed on the top of a transparent document table 2 is illuminated with light by a light source 3, and light reflected from the document is made incident on a lens 6 via reflecting mirrors 4 and 5. The lens 6 focuses the incident light onto a charge-coupled device 7 such as a CCD. The charge-coupled device 7 separates the incident light into individual colors of red (R), green (G) and blue (B), and outputs R, G and B signals as image signals.

Figure 2:
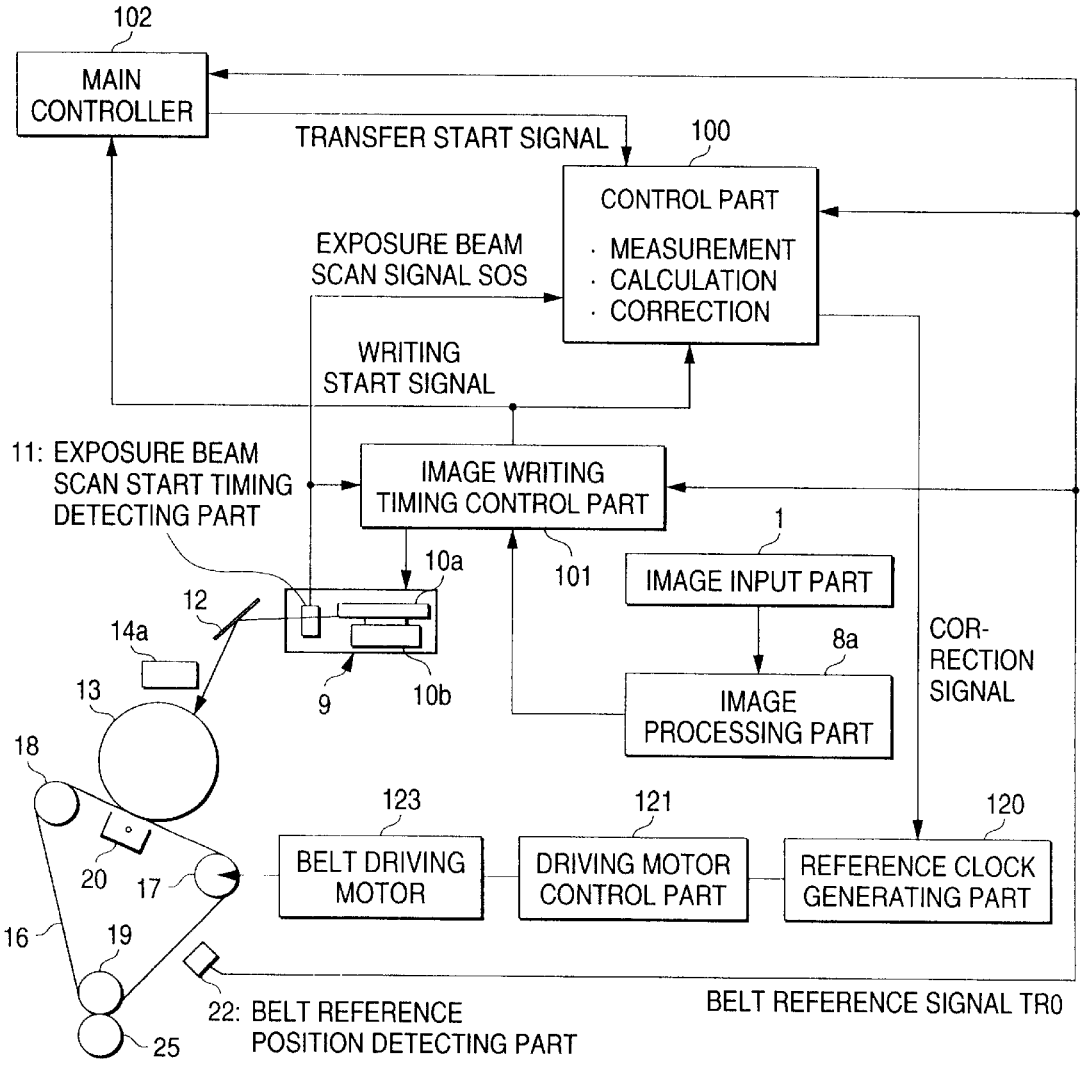
FIG. 2 is a control block diagram of the first embodiment.

As shown in FIG. 2, the image output section 8 has an image processing part 8*a* which converts the R, G and B signals supplied from the image input section 1 into image signals of individual colors Y (yellow), C (cyan) M (magenta) and Bk (black) (Y, M, C and K signals) and stores these image signals. The image signals outputted from the image processing part 8*a* are inputted to an image writing timing control part 101, and an image writing part 9 uses the image signals to modulate a laser beam L. The modulated laser beam L is deflected by a polygon mirror 10*a* which constitutes a light scanning device (or latent image writing part) provided in the image writing part 9, whereby a main scan for image writing is performed at a predetermined period. Incidentally, reference numeral 10*b* denotes a motor which rotates the polygon mirror 10*a*.

An SOS sensor (or detecting part) 11 is disposed on the optical path of the laser beam L, and outputs a scan start (SOS) signal indicative of the start of a main scan when the laser beam L is radiated. The laser beam L is reflected by a reflecting mirror 12 and is made to illuminate the outer surface of a photoconductor drum 13, and is main-scanned in the axial direction of the photoconductor drum 13. By repeatedly executing this main scan at a predetermined period, an electrostatic latent image of a predetermined color (any of Y, M, C and K) is sequentially written to the outer surface of the photoconductor drum 13.

Incidentally, in FIG. 1, reference numeral 14*a* denotes a charger which uniformly charges the outer surface of the photoconductor drum 13 before the electrostatic latent image is written, and reference numeral 14*b* denotes a cleaner which removes toner remaining on the photoconductor drum 13.

When the electrostatic latent image is written to the photoconductor drum 13, development is immediately performed by a developer (or developing part) 15. The developer 15 has Y, M, C and K developing sleeves 15*a* to 15*d*, and supplies a color toner corresponding to the written electrostatic latent image to the photoconductor drum 13 and develops the electrostatic latent image. Then, the thus-formed toner image is primarily transferred to an intermediate transfer belt (or intermediate transfer part) 16 which is maintained in contact with the outer surface of the photoconductor drum 13 at all times.

The intermediate transfer belt 16 is supported for movement or rotation in the circumferential direction of the belt by a driving roll 17 and support rolls 18 and 19. A transfer unit 20 is disposed on the side of the intermediate transfer belt 16 opposite to the photoconductor drum 13. The transfer unit 20 includes a corotoron which applies electric charge opposite in polarity to toner to the intermediate transfer belt 16 and transfers a toner image to the intermediate transfer belt 16. Toner images of Y, M, C and K are sequentially transferred onto the intermediate transfer belt 16, whereby a color toner image made of superimposed images of Y, M, C and K is formed on the intermediate transfer belt 16.

Figure 3:
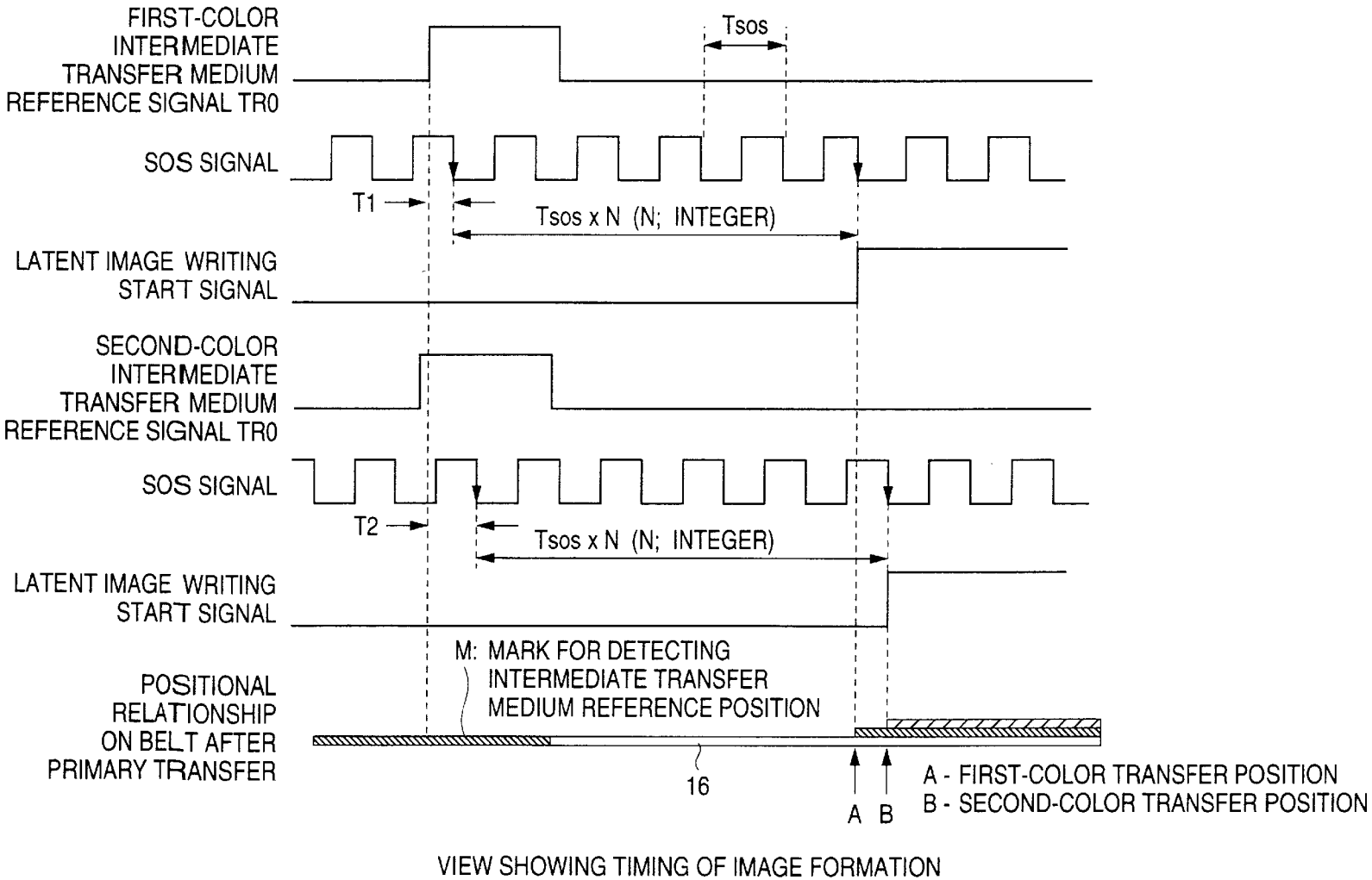
FIG. 3 is a timing chart showing the timing of image formation.

The intermediate transfer belt 16 is rotated at the same speed as the photoconductor drum 13 in the direction opposite to the rotating direction thereof by the driving roll 17. As shown in FIG. 3, a belt driving motor 123 is provided independently of a motor (not shown) which rotates the photoconductor drum 13, and is constructed so as to be rotated by a driving signal different from that used for the motor.

In this manner, the photoconductor drum 13 and the intermediate transfer belt 16 are driven independently of each other, whereby even if the rotational speed of the intermediate transfer belt 16 is increased or decreased to a rotational speed different from that of the photoconductor drum 13, the rotational speed of the photoconductor drum 13 is approximately constant almost without being influenced.

As shown in FIG. 3, a mark M which differs in light reflectance from the intermediate transfer belt 16 is formed on a side surface of the intermediate transfer belt 16. The mark M is detected by a mark sensor (or detecting part) 22 which is a belt reference position detecting part disposed in opposition to the intermediate transfer belt 16, and when the mark M is detected, the mark sensor 22 outputs the belt reference signal TRO shown in FIG. 3. The position of the intermediate transfer belt 16 at that time is determined as a reference position.

Incidentally, in FIG. 1, reference numeral 23 denotes a cleaner which removes the toner remaining on the intermediate transfer belt 16, and reference numeral 25 denotes a secondary transfer roll which is arranged so as to be brought into or out of contact with the support roll 19.

Sheets stacked in a sheet feeding tray 26 are picked up one by one by the pickup roll 27, and a picked-up sheet is supplied to the nip portion between the secondary transfer roll 25 and the support roll 19. At this time, the sheet is electrically charged to have the opposite polarity to that of toner, by the secondary transfer roll 25. In this manner, the toner on the intermediate transfer belt 16 is secondarily transferred to the sheet in the nip portion. Thus, the sheet to which a color toner image has been secondarily transferred from the intermediate transfer belt 16 is sent to a fixing unit 28 so that the toner image is fixed.

As shown in FIG. 2, a main controller 102 is provided in the image writing part 8. The main controller 102 generates various control signals which control various parts of this color image forming apparatus. A control part 100 and an image writing timing control part 101 are connected to the main controller 102, and the control part 100 controls the rotational speed of the intermediate transfer belt 16. The belt reference signal TRO outputted from the mark sensor 22 is inputted to each of the main controller 102, the control part 100 and the image writing timing control part 101. The image writing timing control part 101, when the belt reference signal TRO rises, starts to count the fall of the SOS signal inputted from the SOS sensor 11, and when a predetermined count value is reached, rises a latent image writing start signal (or image formation start signal) which is a signal indicative of the start of writing in a sub-scan direction. Then, the image writing timing control part 101 starts to count a predetermined number of pixel clocks at the time instant when the latent image writing start signal rises. After that, the image writing timing control part 101 reads the stored Y, M, C and K signals from the image processing part 8*a* and sequentially outputs the read signals to the image writing part 9, whereby writing of a latent image to each line in the main-scan direction is started.

The SOS signal and the belt reference signal TRO are inputted to the control part 100, and the control part 100 computes the phase difference between the rotational period of the intermediate transfer belt 16 and the rotational period of the polygon mirror 10*a* from the SOS signal and the belt reference signal TRO. On the basis of the result of the computation and a correction value for correcting a transfer misregistration, the control part 100 outputs to a reference clock generating part 120 a correction signal indicative of a correction value P for increasing or decreasing the rotational speed of the intermediate transfer belt 16.

The reference clock generating part 120 includes a VCO (Voltage Control Oscillator using a PLL (Phase Locked Loop), and outputs a reference clock of frequency proportionate to its input voltage to a driving motor control part 121. The driving motor control part 121 supplies to the belt driving motor 123 an exciting current of frequency corresponding to the supplied reference clock. The belt driving motor 123 uses, for example, a stepping motor or a D.C. brushless motor.

In addition, a transfer start signal BTR indicative of the timing of transfer start outputted from the main controller 102 is inputted to the control part 100, and controls the timing of outputting a correction signal for increasing or decreasing the rotational speed of the intermediate transfer belt 16 and the timing of stopping outputting the correction signal. In other words, in the first embodiment, since the running speed of the intermediate transfer belt 16 is changed in a primary non-image transfer area as will be described later, the control part 100 controls the timing of starting a speed change and the timing of stopping a rotation change, on the basis of the transfer start signal BTR.

Incidentally, in the first embodiment, since it is possible to change the running speed of the intermediate transfer belt 16 in a non-image writing area, the latent image writing start signal outputted from the image writing timing control part 101 is also inputted to the control part 100.

FIG. 3 illustrates the timing of writing latent images of first and second colors, and more specifically, the timing from the instant the image writing timing control part 101 detects the belt reference signal TRO until the instant such latent image starts to be written, as well as an example of a transfer misregistration which appears in the sub-scan direction after a primary transfer. As shown in FIG. 3, the laser beam L is made to scan at all times and the signal from the SOS sensor 11 occurs at a predetermined period at all times, and when the latent image writing start signal rises, a latent image starts to be written. Therefore, the writing of the latent image by the laser beam L is not performed until the latent image writing start signal rises. The laser beam L, after having completed illuminating the SOS sensor 11, reaches the image forming area of the photoconductor drum 13 into which to write the latent image in the main-scan direction, after the passage of a predetermined number of image clocks. For this reason, as shown in FIG. 3, the writing of the latent image in the sub-scan direction is started at the timing of the fall of the signal from the SOS sensor 11. Accordingly, in the first embodiment, the fall of the signal from the SOS sensor 11 is used as a signal indicative of the start of a scan in the sub-scan direction.

In operation, as shown in FIG. 3, the image writing timing control part 101 starts to count the number of falls of the SOS signal, at the time of the rise of the belt reference signal TRO of the first color (for example, yellow), and after having counted N number of falls of the SOS signal, the image writing timing control part 101 causes the latent image writing start signal to rise. In this manner, the writing of a latent image of the first color is started, and then the written latent image is developed with a toner of the first color. Similarly, the image writing timing control part 101 starts to count the number of falls of the SOS signal, at the time of the rise of the belt reference signal TRO of the second color (for example, magenta), and after having counted N number of falls of the SOS signal, the image writing timing control part 101 causes the latent image writing start signal to rise. In this manner, the writing of a latent image of the second color is started, and then the written latent image is developed with a toner of the second color. Subsequently, latent images of third and fourth colors are developed in a similar manner.

Letting T1 represent the time period from the rise of the belt reference signal TRO of the first color until the fall of the first SOS signal and $T_{sos}$ represent the period of the SOS signal, the time period from the detection of the belt reference signal TRO of the first color until the start of the latent image of the first color is represented by $T1+T_{sos}\times N$. Letting T2 represent the time period from the rise of the belt reference signal TRO of the second color until the fall of the first SOS signal, the time period from the detection of the belt reference signal TRO of the second color until the start of the latent image of the second color is represented by $T2+T_{sos}\times N$. Therefore, a temporal difference TE which is represented by T2−T1 (where T1<T2) occurs between the time period from the rise of the belt reference signal TRO of the first color until the writing of the latent image of the first color and the time period from the rise of the belt reference signal TRO of the second color until the writing of the latent image of the second color. In this manner, the writing start timing of the latent image of the second color deviates by T2−T1 from the writing start timing of the latent image of the first color, and this temporal difference TE appears as a distance deviation from the mark M provided on the intermediate transfer belt 16 to a transfer start position, as shown by arrows A and B in FIG. 3.

Assuming that a variation in speed is zero from the detection of the belt reference position until the start of a latent image and the resolution of the laser beam L is A [dpi], a scan line pitch D becomes 25.4/A [mm], so that a misregistration LE in writing start position on the photoconductor drum 13 between the latent image of the first color and the latent image of the second color is represented by $LE=D'(T2-T1)/T_{sos}$[mm]. Therefore, during this state, if a toner image of the second color is transferred to and superimposed on a toner image of the first color, a color misregistration of a maximum of LE [mm] occurs.

Accordingly, letting Tn represent the time period from the rise of the belt reference signal TRO of the nth color (n=2, 3 or 4) until the fall of the first SOS signal on the basis of the first color, the misregistration LE between the second-color toner image and the nth-color toner image is represented as follows:

$$LE=D'(Tn-T1)/T_{sos}[mm].$$

Therefore, in the first embodiment, before the toner image of the second color is superimposed on the toner image of the first color, the rotational speed of the intermediate transfer belt 16, after having been varied at a constant speed variation rate within a predetermined time, is restored to the original speed, thereby correcting the misregistration between the toner images on the intermediate transfer belt 16 due to the misregistration LE between the writing start positions. Similarly, before toner images of the third and fourth colors are superimposed, writing start positions for these toner images are corrected.

Figure 4:
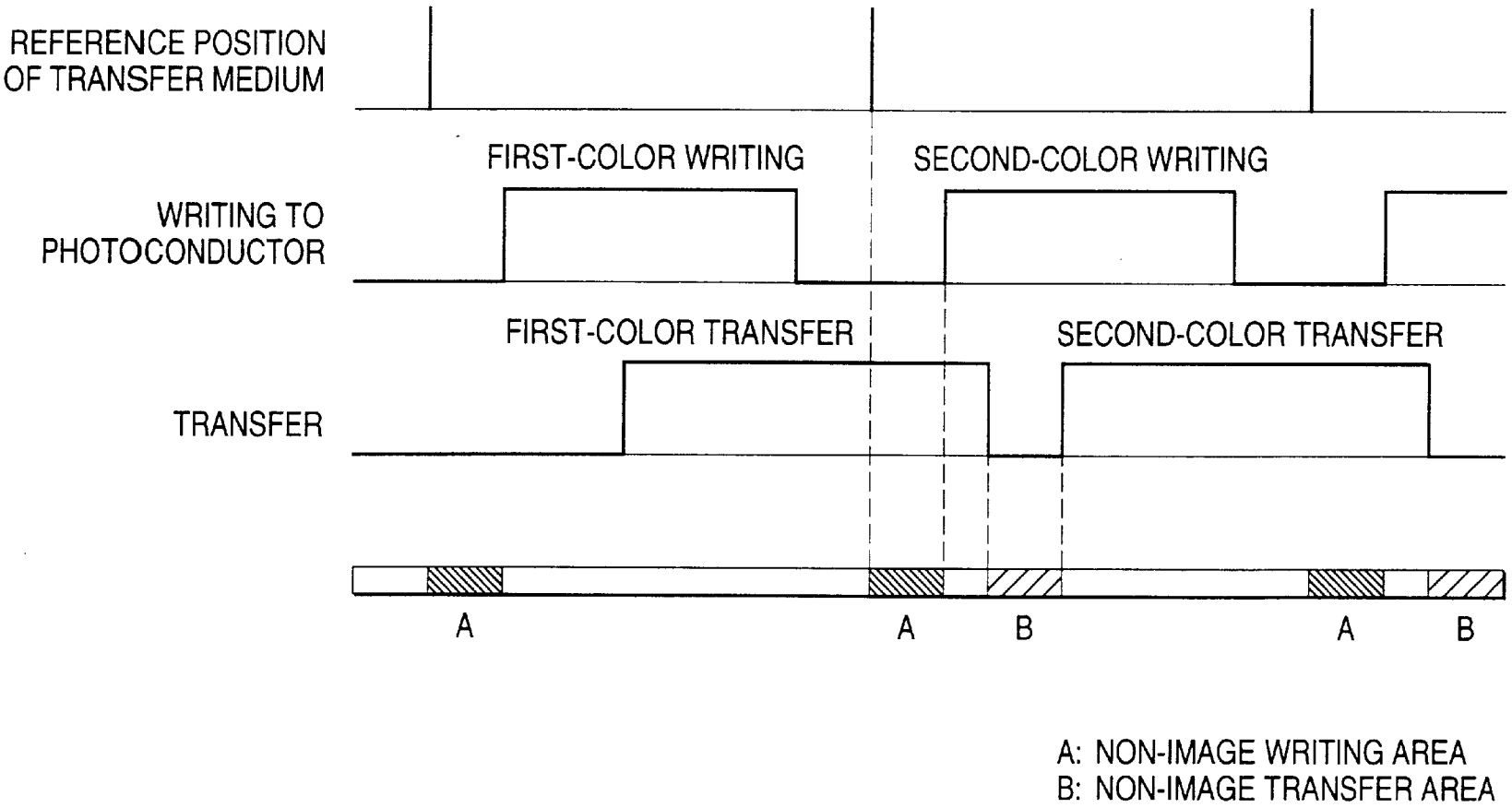
FIG. 4 is a timing chart showing the timing of writing a latent image and transfer.

FIG. 4 is a view illustrating the timing from the writing of the latent images to the photoconductor drum until the transfer of the toner images to the intermediate transfer belt in the first embodiment. In the color image forming apparatus according to the first embodiment, while the intermediate transfer belt is making four rotations, the writing of the latent images of the first to fourth colors to the photoconductor drum is effected, and as shown in FIG. 4, a time zone in which no writing is performed is present between the writing of each of the latent images of the first to fourth colors and the writing of the next one. In FIG. 4, each time zone denoted by symbol A represents the time zone from the instant the reference position of the intermediate transfer belt reaches a predetermined position until the instant the writing of any one of the latent images is started, and such time zone is hereinafter referred to as the non-image writing area.

In addition, in the color image forming apparatus according to the first embodiment, while the intermediate transfer belt is making four rotations, the toner images on the photoconductor drum are transferred to the intermediate transfer belt, and as indicated by symbol B in FIG. 4, a non-image transfer area is present between the transfer of each of the toner images of the first to fourth colors and the transfer of the next one.

In the first embodiment, the belt driving motor 123 which rotates the driving roll 17 and the motor which rotates the photoconductor drum motor 123 are provided independently of each other so that the photoconductor drum and the intermediate transfer belt are rotated by different driving sources with different driving signals. Accordingly, the rotational speed of the intermediate transfer belt can be varied in each non-image transfer area so that a toner image is transferred without being at all affected, whereby the transfer misregistration can be corrected. In addition, since the photoconductor drum and the intermediate transfer belt are independently rotated by different driving sources, the rotational speed of the intermediate transfer belt can be changed almost without the rotational speed of the photoconductor drum being affected. Accordingly, even if the rotational speed of the intermediate transfer belt is changed during the writing of a latent image of the second color or later, almost no images to be written to the photoconductor drum are affected.

Figure 5:
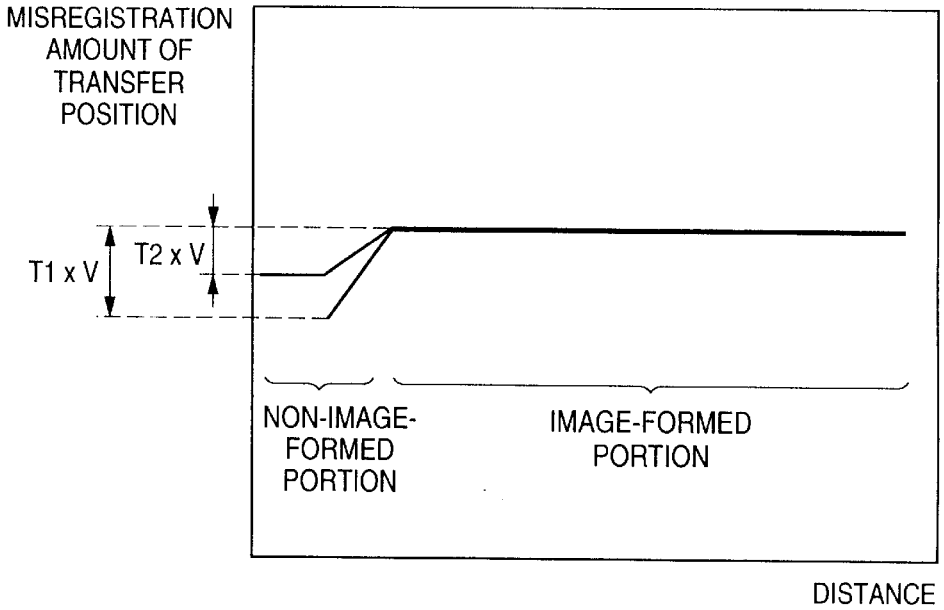
FIG. 5 is a graph showing the correction of the leading edge position of an image.

By correcting the rotational speed of the intermediate transfer belt by an amount corresponding to a transfer misregistration amount in accordance with the above-described timing, misregistrations occurring from the rise of the reference signal for the intermediate transfer belt till the rise of a latent image writing start signal are corrected, and the misregistration of the leading edge of the toner image of each of the first to fourth colors in the sub-scan direction is corrected as shown in FIG. 5.

Incidentally, by controlling the rotational speed of the polygon mirror in each of the non-image writing areas, it is also possible to correct the transfer misregistration.

However, if a variation in load occurs in the intermediate transfer belt, a transfer misregistration occurs as described previously with reference FIGS. 14A and 14B and 15A and 15B. There are a case where a variation in load occurs in the intermediate transfer belt while an image on the photoconductor drum is being transferred to the intermediate transfer belt (during the primary transfer), and a case where a variation in load occurs in the intermediate transfer belt during the time period from the rise of a latent image writing start signal and the start of the primary transfer.

Figure 6:
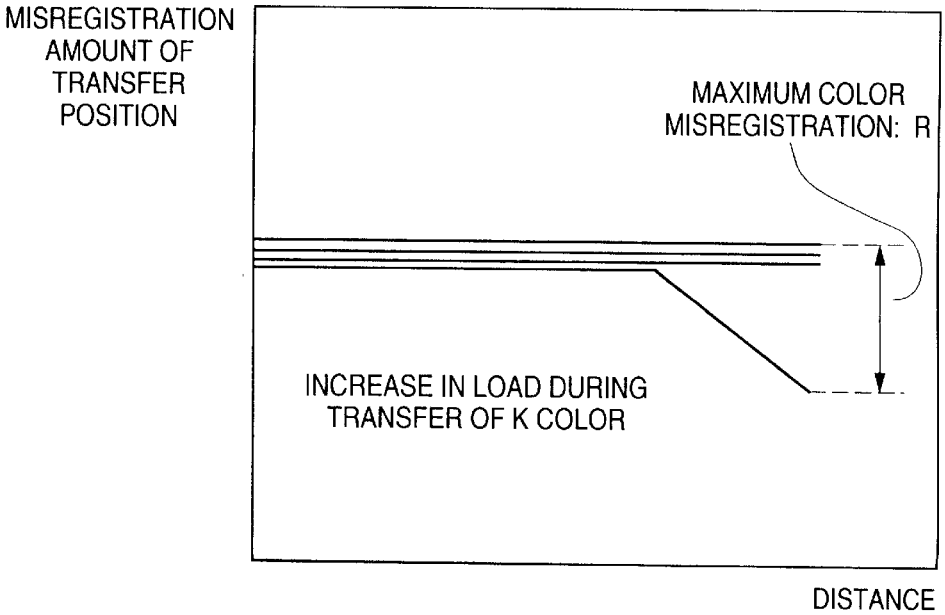
FIG. 6 is a graph showing the misregistration amount of a transfer position in an image-formed portion when a variation in load occurs during primary transfer of K color.
Figure 7:
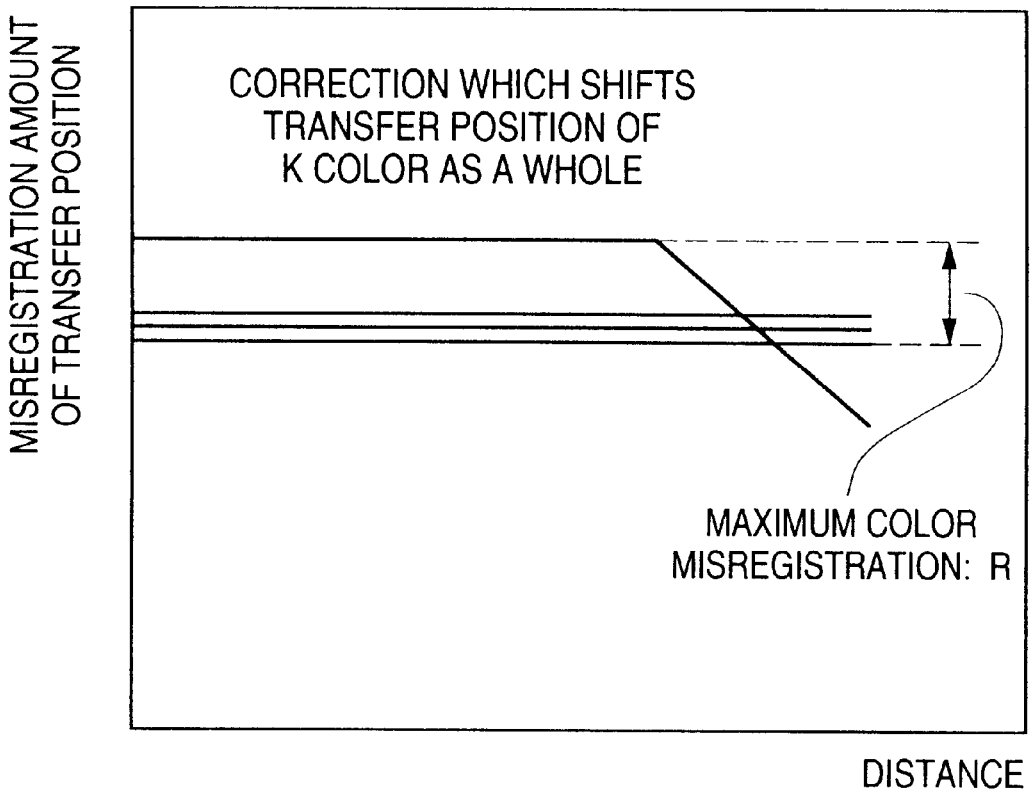
FIG. 7 is a graph showing the misregistration amount of the transfer position after the transfer position of FIG. 6 is corrected.

During the primary transfer, since a variation in load occurs while an image on the photoconductor drum is being transferred to the intermediate transfer belt, a transfer misregistration occurs halfway through the transfer of an image, as shown in FIG. 6. FIG. 6 shows a transfer misregistration occurring when a variation in load occurs during the primary transfer of a toner image of the K color, and shows that a misregistration of up to a maximum of R occurs after the completion of transfer. Therefore, either of the following corrections is effected; one of the corrections is to change, during a non-image writing area, the timing of writing a latent image of a color subjected to a transfer misregistration to the photoconductor drum by controlling the rotational speed of the polygon mirror (in the case of an increase in load, a correction which advances the latent image writing timing, or in the case of a decrease in load, a correction which delays the latent image writing timing); and the other is to change the rotational speed of the intermediate transfer belt during a non-image transfer area (in the case of an increase in load, a correction which increases the rotational speed of the intermediate transfer belt, or in the case of a decrease in load, a correction which decreases the rotational speed of the intermediate transfer belt). At this time, as shown in FIG. 7, the transfer misregistration amount is distributed between locations centered at the transfer position of a reference color in the sub-scan direction. The correction amount at this time is an appropriate value which is previously calculated from the transfer misregistration amount and the timing of occurrence of a variation in load, and is stored in a correction-value memory. By distributing the transfer misregistration amount in this manner, the transfer misregistration amount of the entire image is decreased.

Figure 8:
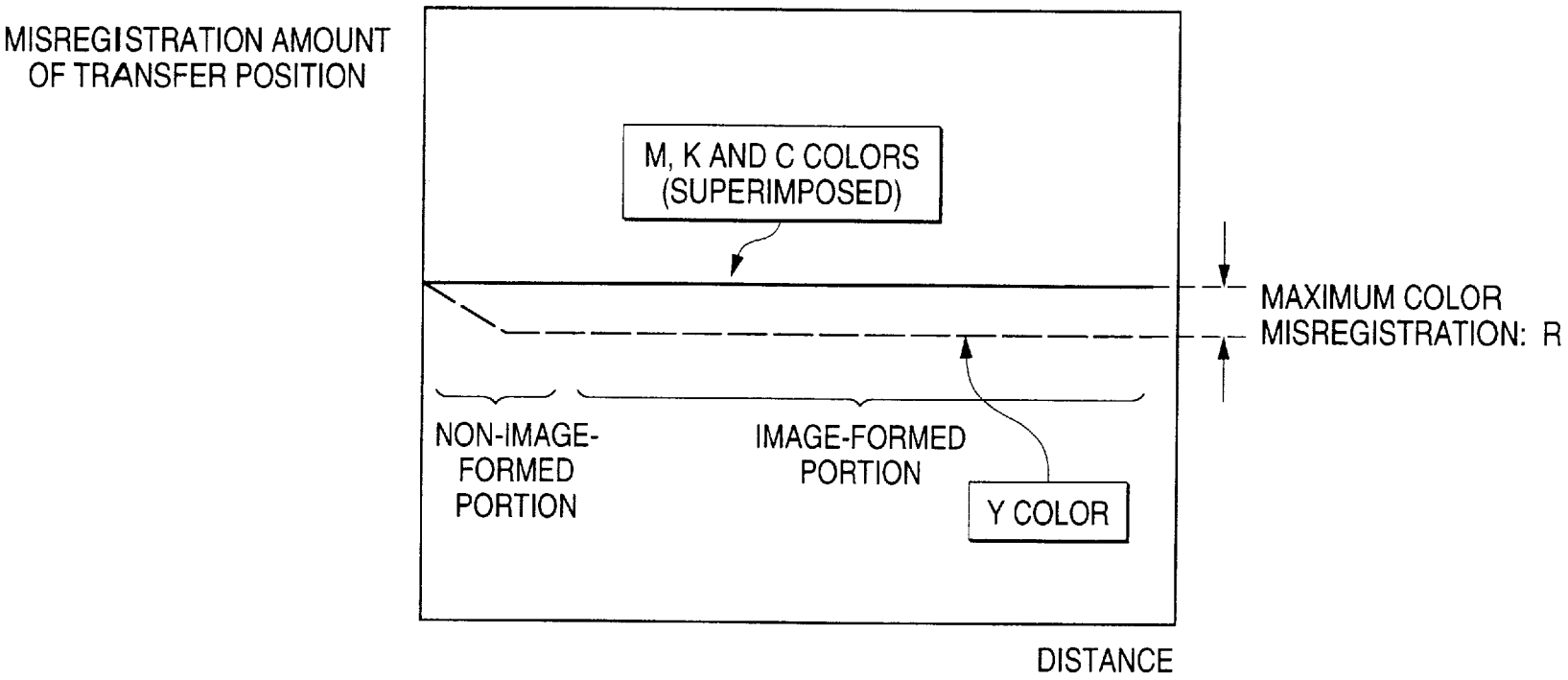
FIG. 8 is a graph showing the misregistration amount of a transfer position in an image-formed portion when a variation in load occurs before writing of a Y-color latent image.
Figure 9:
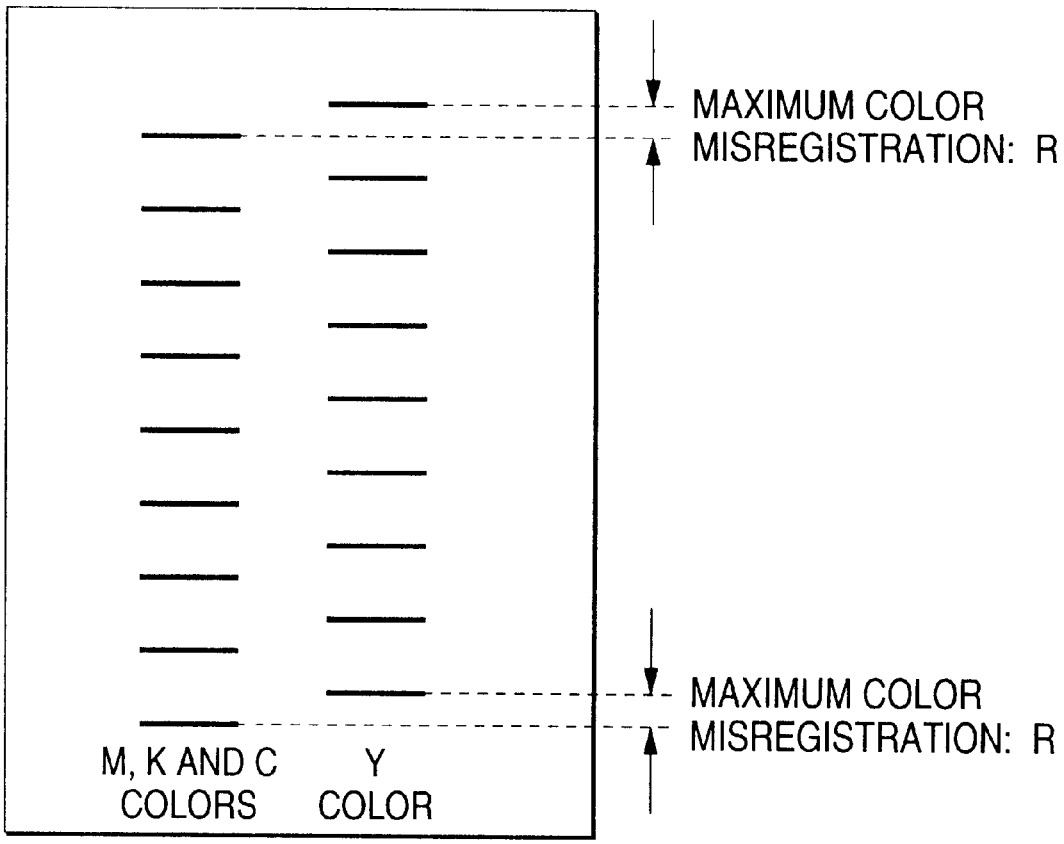
FIG. 9 is a view showing a maximum color misregistration amount when a variation in load occurs before writing of the Y-color latent image.

Until the start of the primary transfer, since a variation in load occurs during the time period from the rise of each latent image writing start signal until the start of the primary transfer, the transfer start position of the intermediate transfer belt relative to the photoconductor drum is deviated and a transfer misregistration occurs over the entire image, as shown in FIG. 8. FIG. 8 shows a transfer misregistration which is caused when a variation in load occurs during the time period from the rise of a K-color latent image writing start signal until the start of the primary transfer, and a misregistration of a maximum of R occurs at each of the leading and trailing edges of a transferred image in the sub-scan direction thereof.

Therefore, either of the following corrections similar to the above-described ones is effected; one of the corrections is to change, during a non-image writing area, the start timing of writing a latent image of a color subjected to a transfer misregistration to the photoconductor drum by controlling the rotational speed of the polygon mirror; and the other is to change the rotational speed of the intermediate transfer belt during a non-image transfer area. Unlike the corrections to be effected during the primary transfer, the correction amount at this time is equivalent to the maximum misregistration amount. In this case as well, an appropriate correction value is previously calculated from the transfer misregistration amount and the timing of occurrence of a variation in load, and is stored in a correction-value memory. By correcting the transfer misregistration amount in this manner, the transfer misregistration amount of the entire image is decreased.

If a variation in load occurs in the intermediate transfer belt during the time period from the rise of a latent image writing start signal through the primary transfer, a transfer misregistration occurs which has the properties of the transfer misregistration occurring during the primary transfer and those of the transfer misregistration occurring before the primary transfer. In this case, a correction amount may be determined by combining the above-described correction quantities.

A processing routine for correcting a misregistration when a variation in load occurs in the intermediate transfer belt will be described below on the basis of the above-described principles.

Figure 10:
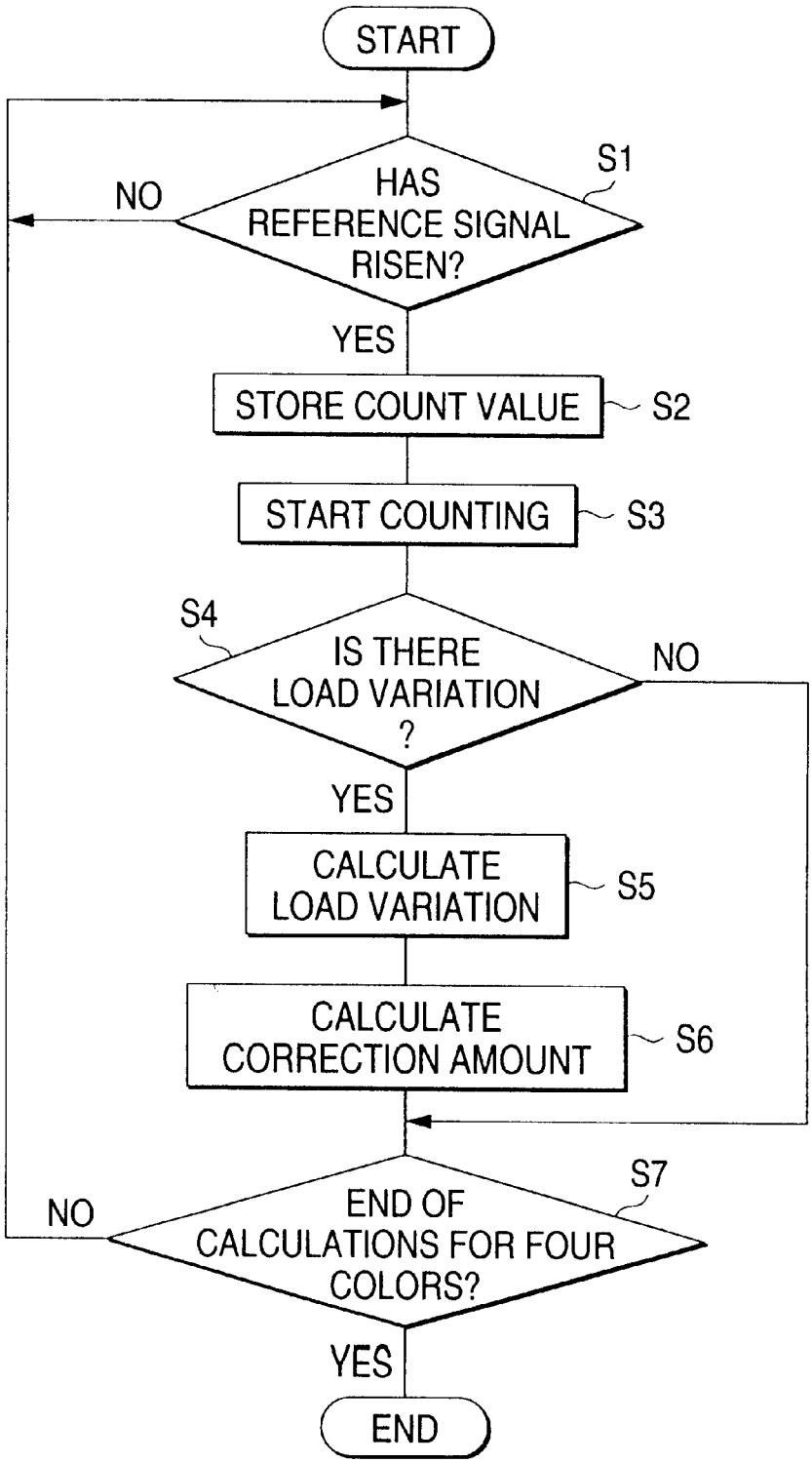
FIG. 10 is a flowchart showing a routine which computes a correction amount for correcting a transfer misregistration.

FIG. 10 shows a routine which computes a correction amount for correcting a misregistration due to a variation in load. In Step S1 it is determined whether a belt reference signal has risen, and if the belt reference signal rises, the process proceeds to Step S2, in which the count value of a counter at that time is stored in a memory as the period of a latent image writing start signal. Then, in Step S3, the counter is reset to restart counting. In Step S4, the previously stored period and the presently stored period are compared with each other to determine whether a variation in period has occurred in the intermediate transfer belt, i.e., whether a variation in load has occurred in the intermediate transfer belt.

If a variation in load occurs in the intermediate transfer belt, the process proceeds to Step S5, in which the difference between the previous period and the present period is computed to compute the maximum value R of the transfer misregistration amount. In Step S5, as described previously, a correction amount for correcting a transfer misregistration is calculated and stored in the correction-amount memory. In Step S7, it is determined whether the correction quantities required to cope with variations in load relative to all the four colors have been calculated. If the calculation of the correction quantities for all the four colors is completed, this routine is brought to an end, whereas if such calculation is not yet completed, the process returns to Step S1 and the above-described processing is repeated.

Through the above-described processing, the correction quantities required to correct the transfer misregistrations due to the variations in load occurring in the intermediate transfer belt are respectively calculated on the four colors, and are stored in the correction-amount memory.

Figure 11:
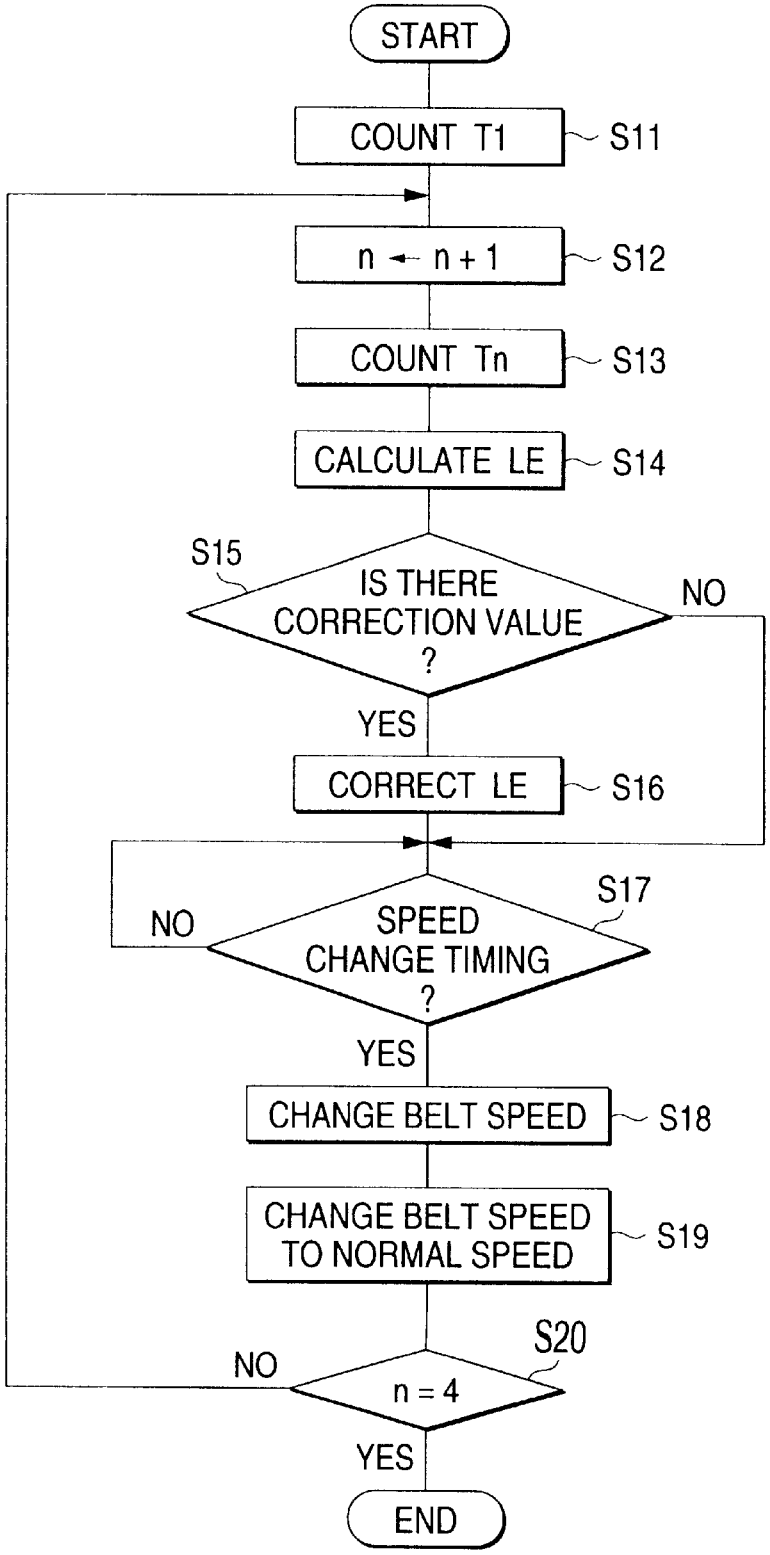
FIG. 11 is a flowchart showing a routine for increasing or decreasing the rotational speed of the intermediate transfer belt and correcting a transfer misregistration.

FIG. 11 shows a routine for correcting the rotational speed of the intermediate transfer belt and correcting a transfer misregistration. In Step S11, clocks are counted to count a time period T1 from the rise of the intermediate transfer belt reference signal of the first color until the first fall of the SOS signal. In Step S12, a count value n which is previously initialized to "0" is incremented, and in Step S13, a time period Tn from the rise of an intermediate transfer belt reference signal of the nth color until the first fall of the SOS signal is counted. In Step S14, the misregistration amount LE of the nth color with respect to the time period T1 of the first color is calculated on the basis of the above-described expression.

In Step S15, it is determined whether the correction value for the nth color computed in the routine of FIG. 10 is stored in the correction-value memory. If the correction value is stored in the correction-value memory, the misregistration amount LE of the nth color is corrected with the correction value so that a transfer misregistration correction corresponding to the correction value is effected.

In Step S17, it is determined whether the timing of the intermediate transfer belt is speed change timing such as the above-described primary non-image transfer area. In the case of speed change timing, the process proceeds to Step S18, in which a correction signal indicative of a correction amount is inputted to the reference clock generating part to control the rotational speed of the belt driving motor, thereby correcting the rotational speed of the intermediate transfer belt. Specifically, a correction amount P of the speed of the motor which drives the intermediate transfer belt 16 is a coefficient for changing the frequency of the reference clock to be generated by the reference clock generating part 120, and this correction amount P and the initial frequency of the reference clock are multiplied and the result of this computation is allotted to the frequency of the reference clock to be outputted from the reference clock generating part 120, whereby the rotational speed of the intermediate transfer belt 16 is increased or decreased with respect to the initial normal speed.

In Step S19, in the speed change area of the intermediate transfer belt such as the primary non-image transfer area, the rotational speed of the belt driving motor is controlled to perform control to restore the rotational speed of the intermediate transfer belt to the normal speed. Then, in Step S20, it is determined whether the speed changes of the intermediate transfer belt required to cope with variations in load relative to all the four colors have been completed. If the speed change processing is completed for all the four colors, this routine is brought to an end, whereas if the speed change processing is not yet completed for all the four colors, the process returns to Step S1 and the above-described processing is repeated.

Through the above-described processing, the correction which increases or decreases the rotational speed of the intermediate transfer belt is effected in the primary non-image transfer area or the like. In this case, the correction amount is made as small as possible because if the correction amount of the rotational speed is excessively large, a slip is liable to occur between the intermediate transfer belt 16 and the driving roll 17. Accordingly, the rotational speed of the intermediate transfer medium is increased or decreased over the entire speed change area by making the best use of the time period of the intermediate-transfer-belt speed change area such as the primary non-image transfer area.

In the color image forming apparatus having the above-described construction, since the rotational speed of the intermediate transfer belt 16 is changed in the primary non-image transfer area, a toner image to be transferred is not at all affected. In addition, since the photoconductor drum and the intermediate transfer belt are respectively driven by different motors, even if the rotational speed of the intermediate transfer belt is changed, the rotational speed of the photoconductor drum is hardly affected. Accordingly, even if the rotational speed of the intermediate transfer belt is changed during the writing of a latent image of the second color or later, the latent image to be written to the photoconductor drum is hardly affected. In this manner, in the color image forming apparatus, neither the latent image to be written nor the toner image to be transferred is affected, whereby it is possible to prevent the color misregistration of the toner image to be transferred.

In the first embodiment in particular, by rotating the intermediate transfer belt at a correction speed over the entire primary non-image transfer area, it is possible to reduce the correction amount P of the rotational speed. Accordingly, it is possible to prevent a slip from occurring between the intermediate transfer belt 16 and the driving roll 17, and it is also possible to reliably prevent the color misregistration between toner images.

Although the above description of the first embodiment has referred to an example in which, in the primary non-image transfer area, the rotational speed of the intermediate transfer belt is increased or decreased to correct the transfer misregistration, the rotational speed of the polygon mirror which constitutes a light scanning device (or latent image writing part) may, in the non-image writing area, be increased or decreased to change the latent image writing start timing, thereby correcting the transfer misregistration.

In the case of a color image forming apparatus which rotates a photoconductor drum and an intermediate transfer belt by using a single driving source, or in the case of a color image forming apparatus which uses a single kind of driving signal to drive plural driving sources which independently drive a photoconductor drum and an intermediate transfer belt, even if the rotational speed of the intermediate transfer belt is changed in the non-image writing area in which no writing of a latent image to the photoconductor drum is performed, no images to be written to the photoconductor drum are affected at all, whereby the transfer misregistration can be corrected in a manner similar to the above-described one. In this case, when the driving signal is changed, the rotational speeds of both the photoconductor drum and the intermediate transfer belt change similarly and almost no difference in speed occurs between both of them. Accordingly, even if the rotational speed of the intermediate transfer belt is changed during the transfer of a toner image, the toner image to be transferred is hardly affected.

In addition, in the color image forming apparatus which rotates the photoconductor drum and the intermediate transfer belt by using the single driving source, or in the color image forming apparatus which uses the single kind of driving signal to drive plural driving sources which independently drive the photoconductor drum and the intermediate transfer belt, the transfer misregistration can similarly be corrected even by changing the rotational speed of the polygon mirror in the non-image writing area.

A second embodiment of the invention will be described below with reference to FIG. 12. In the second embodiment, the intermediate transfer belt shown in FIG. 1 is omitted, and a photoconductor belt is used in place of the photoconductor drum. For this reason, in FIG. 12, identical reference numerals are used to denote parts identical to the corresponding parts shown in FIG. 1, and the same description is omitted.

Figure 12:
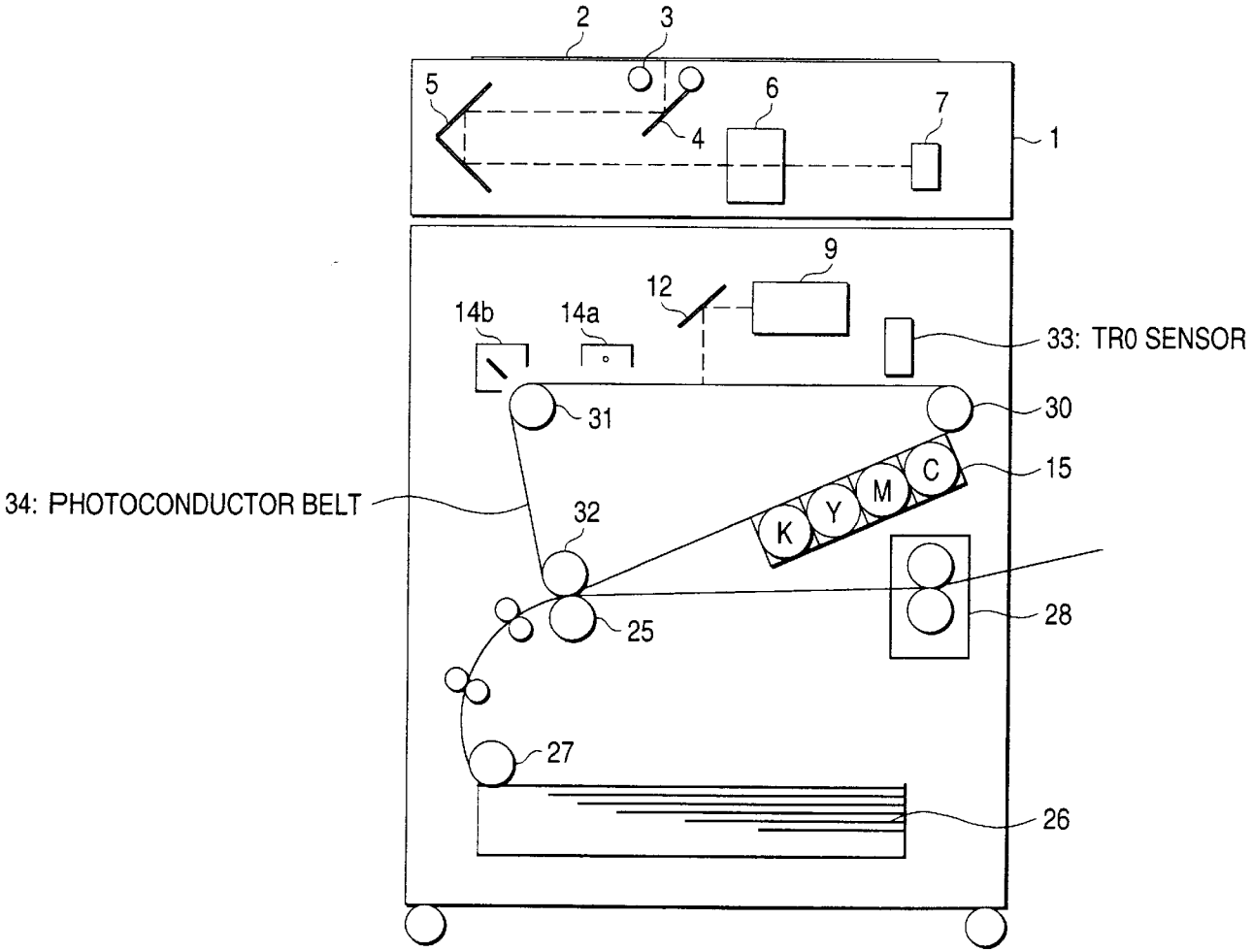
FIG. 12 is a cross-sectional side view showing a color image forming apparatus according to a second embodiment of the invention.
Figure 13:
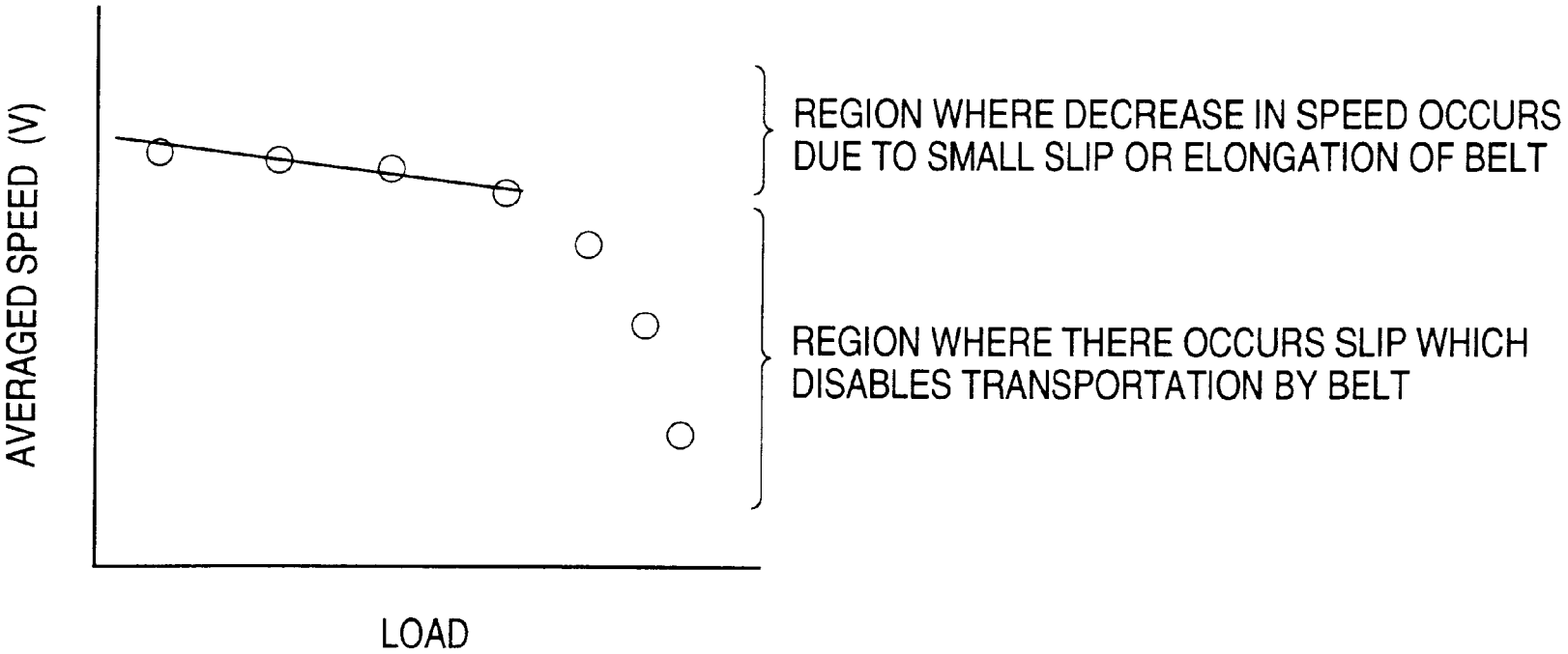
FIG. 13 is a graph showing the relationship between a load acting on a belt-shaped image carrier and the speed thereof.
Figure 14A:
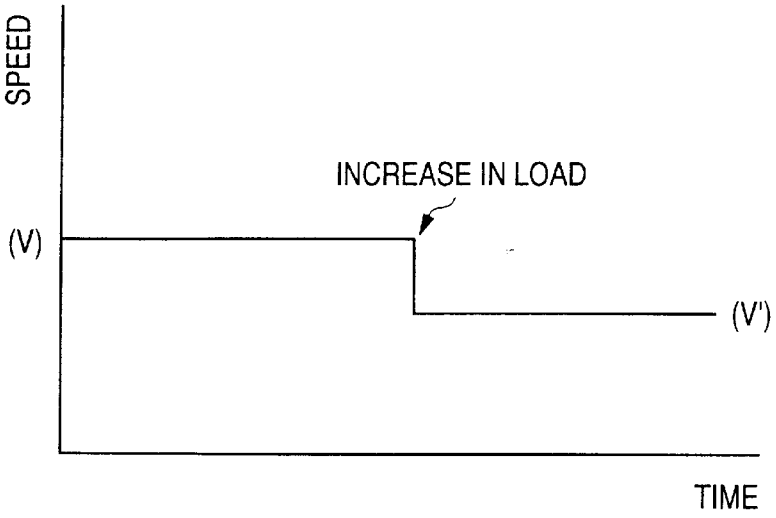
FIG. 14A is a graph showing the state in which an average speed varies with an increase in load.
Figure 14B:
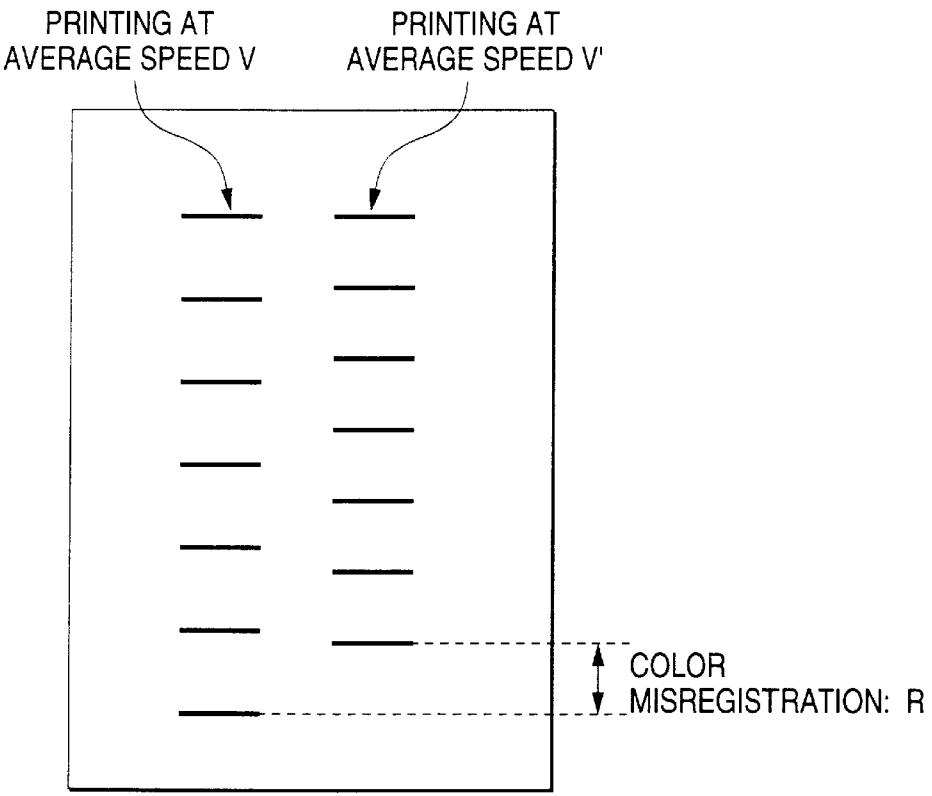
FIG. 14B is a graph showing the state in which a print position gradually deviates due to a difference in an average speed.

As shown in FIG. 12, a photoconductor belt 34 is supported for movement or rotation in the circumferential direction of the belt by a driving roll 30 and support rolls 31 and 32. A mark which differs in light reflectance from the photoconductor belt 34 is formed on a side surface of the photoconductor belt 34. The mark is detected by a mark sensor (or detecting part) 33 which is disposed in opposition to the photoconductor belt 34, and when the mark M is detected, the mark sensor 33 outputs an image formation start signal which serves as the reference of start of image formation. Then, the timing of writing a latent image is set on the basis of the rise of the image formation start signal.

In the second embodiment, when a variation in load occurs in the photoconductor belt, the position of a latent image to be written to the photoconductor belt is deviated by the variation in load and the misregistration of a toner image occurs, so that a color misregistration occurs in a multicolor image. In case that the variation in load occurs during the writing of the latent image, a latent image which causes a transfer misregistration such as that shown in FIG. 6 of the first embodiment occurs during latent-image writing. Accordingly, as described in correction with the first embodiment, a correction may be performed to distribute the misregistration amount of a latent image writing position in the sub-scan direction on the basis of the writing start position of a latent image of a reference color.

If a variation in load occurs between the rise of a latent image writing start signal and the start of latent image writing, a latent image which causes a transfer misregistration such as that shown in FIG. 8 of the first embodiment occurs during the latent image writing. Accordingly, it is preferable to correct all misregistration quantities of latent image writing positions as described in connection with the first embodiment.

In accordance with the correction timing of the second embodiment, during the time period from the rise of an image formation start signal until the start of latent image writing, i.e., while no latent image is being written to the photoconductor belt, the rotational speed of the photoconductor belt may be increased or decreased, or the rotational speed of the polygon mirror may be increased or decreased to correct the timing of writing a latent image In the second embodiment, since the image formation start signal is outputted from the mark sensor, the rotational period of the photoconductor belt can be detected from the image formation start signal, and the misregistration amount of a latent image writing position can be calculated as described in connection with the first embodiment, by comparing the rotational period detected when a variation in load occurs and the rotational period detected when a variation in load does not occur.

Then, in a manner similar to that described in connection with the first embodiment, correction quantities are stored in a memory and the rotational speed or the latent image writing timing of the photoconductor belt is corrected at the above-described correction timing, whereby the color misregistration can be corrected.

Figure 15A:
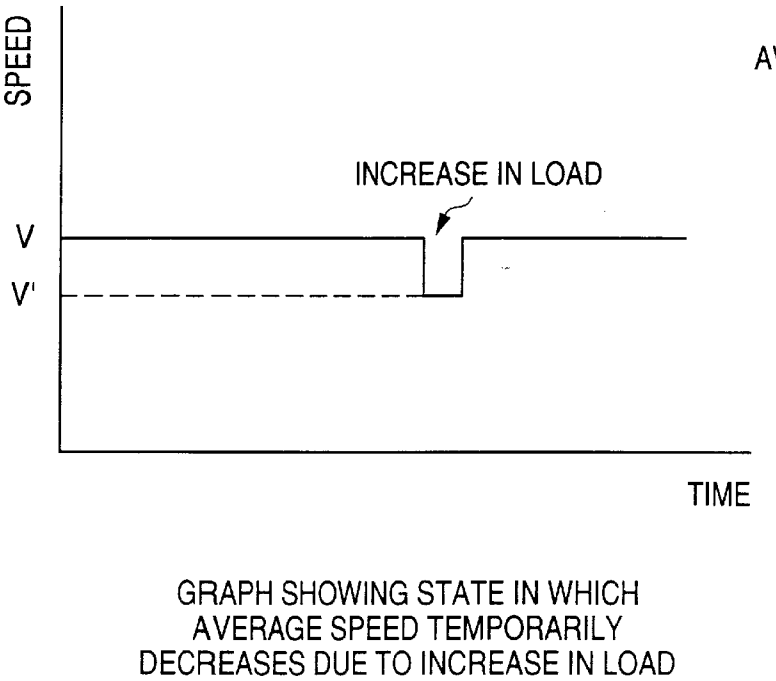
FIG. 15A is a graph showing the state in which an average speed varies with a temporary increase in load.
Figure 15B:
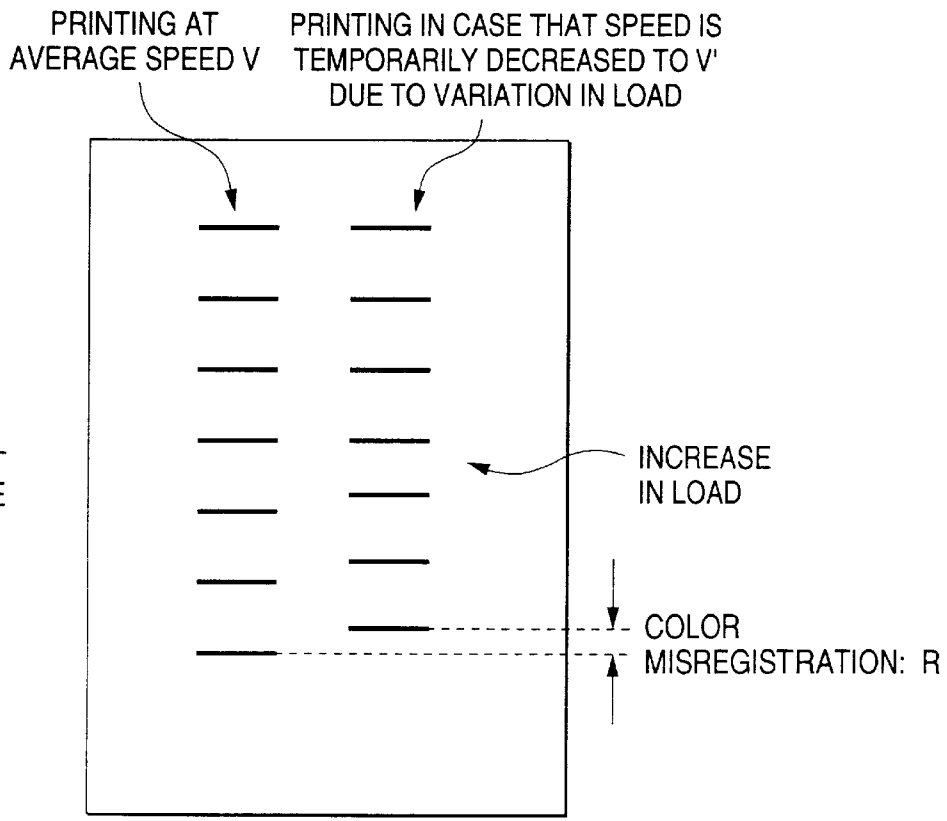
FIG. 15B is a graph showing the state in which a print position gradually deviates due to a temporary decrease in average speed.

Although the above description has referred to an example which uses a belt-shaped intermediate transfer medium and photoconductor, the invention can also be applied to a color image forming apparatus which uses an intermediate transfer drum in place of an intermediate transfer belt, or to a color image forming apparatus which uses a photoconductor drum in place of a photoconductor belt. However, in either apparatus, since a speed variation only temporarily occurs in the rotational speed of the intermediate transfer or photoconductor drum, latent image writing misregistrations and transfer misregistrations are as shown in FIG. 15B.

The above description has referred to several examples of an image forming apparatus which includes: a detecting part which detects the phase difference between the rotational period of an intermediate transfer belt and the rotational period of a polygon mirror; and a phase correcting part which corrects the phase difference on the basis of the detected phase difference, and which increases or decreases the rotational speed of the intermediate transfer belt or the polygon mirror to effect correction to synchronize both rotational periods. However, the phase difference need not necessarily be corrected so that the rotational period of the intermediate transfer belt and the rotational period of the polygon mirror are synchronized with each other.

Figure 16:
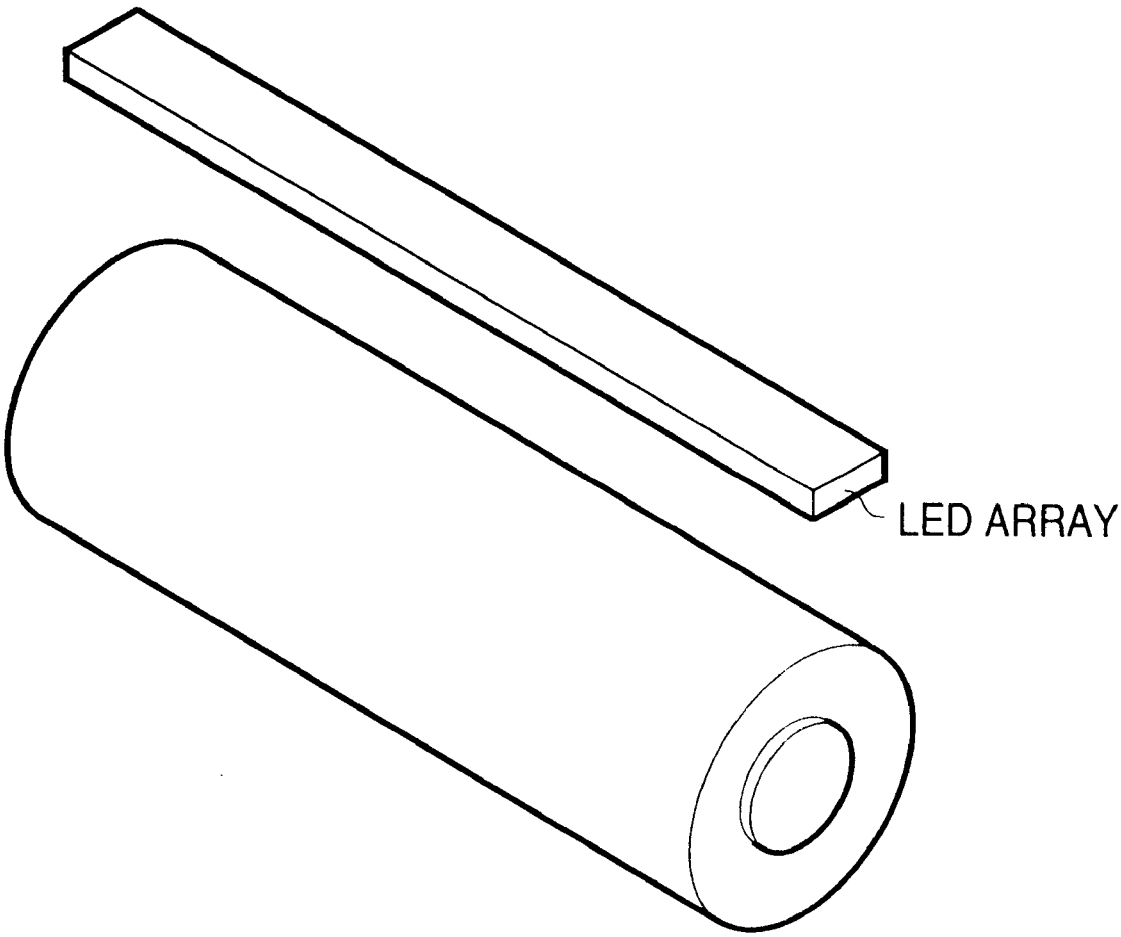
FIG. 16 is a drawing showing an example of a scanning system using a LED array.

The above description has referred to several examples which use a light scanning device made of a laser source and a polygon mirror as a latent image writing part. However, a light emitting element array using a linear light source such as an LED array of the type shown in FIG. 16 may also be used so that the ON timing of the LED array can be varied to correct the transfer misregistration or the latent image writing misregistration.

Other methods of detecting the transfer misregistration amount or the latent image writing misregistration amount will be described below.

In each of the first and second embodiments, the transfer misregistration or the latent image writing misregistration is calculated by measuring the period of the intermediate transfer medium or the photoconductor, but if transfer misregistrations or latent image writing misregistrations relative to load variation quantities are previously calculated, as by measurement, it is possible to predict a transfer misregistration or a latent image writing misregistration and calculate a correction value, by detecting a load variation amount. The load variation amount can be detected by detecting the value of the current of a driving motor which drives the intermediate transfer medium or the photoconductor.

Otherwise, the correction value may be calculated by making an actual printout of a test pattern which enables check of a print misregistration for each color, and measuring the printed image.

The load variation quantities of the intermediate transfer medium and the photoconductor often depend on environmental variations or aging effects. Accordingly, in the invention, it is more effective to determine a correction value by manually or automatically calculating the correction value at a predetermined period.

In the invention, correction is performed on a transfer misregistration or a latent image writing misregistration due to a variation in load in the intermediate transfer belt or the photoconductor, but if the amount of correction is excessively large, it takes time to stabilize the rotational speed of the polygon mirror or that of the intermediate transfer medium (or the photoconductor). If the writing of a latent image is started before such rotational speed stabilizes, the writing position or the transfer position of the latent image will deviate. Accordingly, in case that a correction value is equal to or greater than a latent image writing pitch, it is possible to achieve accurate correction not by correcting an integer multiple of the latent image writing pitch but by delaying or advancing the start of latent image writing by an amount equivalent to the integer pitch.

As is apparent from the foregoing description, the invention can provide the advantage that it is possible to correct the transfer misregistration of a toner image to be transferred, without the need to use a special mechanism and without affecting the toner image to be transferred nor an image to be written to a photoconductor.

In addition, since it is possible to reduce the correction amount of the misregistration of a toner image to be transferred, it is possible to obtain the advantage of solving various problems due to increases or decreases in the speed of a transfer medium.

Moreover, since the speed of the transfer medium is moderately increased or decreased, it is possible to obtain the advantage of solving various problems due to increases or decreases in the speed of the transfer medium.

What is claimed is:

1. An image forming apparatus which superimposes multiple color images on each other on an intermediate transfer medium by rotating a photoconductor and the intermediate transfer medium by a driving source using an identical driving signal and forms a color image, comprising:

a misregistration correcting part which, when each of the multiple color images is to be transferred to the intermediate transfer medium, increases or decreases a rotational speed of the intermediate transfer medium while no latent image is being formed on the photoconductor to correct a transfer misregistration caused by a variation in load acting on the intermediate transfer medium, said variation in load detected by a load variation detecting part.

2. The image forming apparatus according to claim 1, wherein the transfer misregistration caused by the variation in load acting on the intermediate transfer medium is calculated from a difference between the rotational period of the intermediate transfer medium when a variation in load is applied thereto and the rotational period of the intermediate transfer medium when no variation in load is applied thereto.

3. An image forming apparatus which superimposes multiple color images on each other on an intermediate transfer medium by rotating a photoconductor and the intermediate transfer medium by a driving source using different driving signals and forms a color image, comprising:

a misregistration correcting part which, when each of the multiple color images is to be transferred to the intermediate transfer medium, increases or decreases a rotational speed of the intermediate transfer medium while no image is being transferred to the intermediate transfer medium to correct a transfer misregistration caused by a variation in load acting on the intermediate transfer medium, said variation in load detected by a load variation detecting part.

4. The image forming apparatus according to claim 3, wherein the transfer misregistration caused by the variation in load acting on the intermediate transfer medium is calculated from a difference between the rotational period of the intermediate transfer medium when a variation in load is applied thereto and the rotational period of the intermediate transfer medium when no variation in load is applied thereto.

5. An image forming apparatus which superimposes multiple color images on each other on an intermediate transfer medium by rotating a photoconductor and the intermediate transfer medium by a driving source using identical or different driving signals and forms a color image, comprising:

a misregistration correcting part which corrects a transfer misregistration caused by a variation in load acting on the intermediate transfer medium, by increasing or decreasing a rotational speed of a light scan device which is to form a latent image on the photoconductor, while no latent image is being formed on the photoconductor said variation in load detected by a load variation detecting part, and wherein the transfer misregistration caused by the variation in load acting on the intermediate transfer medium is calculated from a difference between the rotational period of the intermediate transfer medium when a variation in load is applied thereto and the rotational period of the intermediate transfer medium when no variation in load is applied thereto.

6. An image forming apparatus which superimposes multiple color images on each other on an intermediate transfer medium by rotating a photoconductor and the intermediate transfer medium by a driving source using identical or different driving signals and forms a color image, comprising:

a misregistration correcting part which corrects a transfer misregistration caused by a variation in load acting on the intermediate transfer medium, by changing on ON timing of a light emitting element array which is to form a latent image on the photoconductor, while no latent image is being formed on the photoconductor, said variation in load detected by a load variation detecting part.

7. The image forming apparatus according to claim 6, wherein the transfer misregistration caused by the variation in load acting on the intermediate transfer medium is calculated from a difference between the rotational period of the intermediate transfer medium when a variation in load is applied thereto and the rotational period of the intermediate transfer medium when no variation in load is applied thereto.

8. An image forming apparatus which superimposes multiple color images on each other on an intermediate transfer medium by rotating a photoconductor and the intermediate transfer medium by a driving source using an identical driving signal and forms a color image, comprising:

a detecting part which detects a phase difference between a timing of forming a latent image on the photoconductor and a rotational speed of the intermediate transfer medium;

a phase correcting part which corrects the phase difference by increasing or decreasing a rotational speed of the intermediate transfer medium on the basis of a detection result provided by the detecting part, while no latent image is being formed on the photoconductor; and a misregistration correcting part which corrects, by using the phase correcting part, a transfer misregistration caused by a variation in load acting on the intermediate transfer medium when each of the multiple color images is to be formed on the intermediate transfer medium, said variation in load detected by a load variation detecting part.

9. The image forming apparatus according to claim 8, wherein the transfer misregistration caused by the variation in load acting on the intermediate transfer medium is calculated from a difference between the rotational period of the intermediate transfer medium when a variation in load is applied thereto and the rotational period of the intermediate transfer medium when no variation in load is applied thereto.

10. An image forming apparatus which superimposes multiple color images on each other on an intermediate transfer medium by rotating a photoconductor and the intermediate transfer medium by a driving source using different driving signals and forms a color image, comprising:

a detecting part which detects a phase difference between a timing of forming a latent image on the photoconductor and a rotational speed of the intermediate transfer medium;

a phase correcting part which corrects the phase difference by increasing or decreasing a rotational speed of the intermediate transfer medium on the basis of a detection result provided by the detecting part, while no image is being transferred to the intermediate transfer medium;

a misregistration correcting part which corrects, by using the phase correcting part, a transfer misregistration caused by a variation in load acting on the intermediate transfer medium when each of the multiple color images is to be formed on the intermediate transfer medium, said variation in load detected by a load variation detecting part; and wherein the transfer misregistration caused by the variation in load acting on the intermediate transfer medium is calculated from a difference between the rotational period of the intermediate transfer medium when a variation in load is applied thereto and the rotational period of the intermediate transfer medium when no variation in load is applied thereto.

11. An image forming apparatus which superimposes multiple color images on each other on an intermediate transfer medium by rotating a photoconductor and the intermediate transfer medium by using a driving source using identical or different driving signals and by rotating a latent image forming part, and forms a color image, comprising:

a detecting part which detects a phase difference between a timing of forming a latent image on the photoconductor and a rotational speed of the intermediate transfer medium;

a phase correcting part which corrects the phase difference by increasing or decreasing a rotational speed of the intermediate transfer medium on the basis of a detection result provided by the detecting part, while no latent image is being formed on the photoconductor;

a misregistration correcting part which corrects, by using the phase correcting part, a transfer misregistration caused by a variation in load acting on the intermediate transfer medium when each of the multiple color images is to be transferred to the intermediate transfer medium, said variation in load in load detected by a load variation detecting part; and wherein the transfer misregistration caused by the variation in load acting on the intermediate transfer medium is calculated from a difference between the rotational period of the intermediate transfer medium when a variation in load is applied thereto and the rotational period of the intermediate transfer medium when no variation in load is applied thereto.

12. An image forming apparatus which superimposes multiple color images on each other on a photoconductor by rotating it and forms a color image, comprising:

a misregistration correcting part which, when a latent image of each of the multiple color images is to be formed on the photoconductor, increases or decreases a rotational speed of a light scan device which is to form a latent image on the photoconductor, while no latent image is being formed on the photoconductor to correct a latent image forming misregistration caused by a variation in load acting on the photoconductor said variation in load detected by a load variation detecting part; and wherein the latent image forming misregistration caused by the variation in load acting on the photoconductor is calculated from a difference between the rotational period of the photoconductor when a variation in load is applied thereto and the rotational period of the photoconductor when no variation in load is applied thereto.

13. An image forming apparatus which superimposes multiple color images on each other on a photoconductor by rotating it and forms a color image, comprising:

a misregistration correcting part which, when a latent image of each of the multiple color images is to be formed on the photoconductor, changes an ON timing of a light emitting element array which is to form a latent image on the photoconductor, while no latent image is being formed on the photoconductor to correct a latent image forming misregistration caused by a variation in load acting on the photoconductor said variation in load detected by a load variation detecting part, and wherein the latent image forming misregistration caused by the variation in load acting on the photoconductor is calculated from a difference between the rotational period of the photoconductor when a variation in load is applied thereto and the rotational period of the photoconductor when no variation in load is applied thereto.

14. An image forming apparatus which superimposes multiple color images on each other on a photoconductor by rotating it and forms a color image, comprising:

a detecting part which detects a phase difference between a timing of forming a latent image on the photoconductor and a rotational speed of the photoconductor;

a phase correcting part which corrects the phase difference by increasing or decreasing a rotational speed of the photoconductor on the basis of a detection result provided by the detecting part, while no latent image is being formed on the photoconductor;

a misregistration correcting part which corrects, by using the phase correcting part, a latent image forming misregistration caused by a variation in load acting on the photoconductor when a latent image of each of the multiple color images is to be formed on the photoconductor, said variation in load detected by a load variation detecting part; and wherein the latent image forming misregistration caused by the variation in load acting on the photoconductor is calculated from a difference between the rotational period of the photoconductor when a variation in load is applied thereto and the rotational period of the photoconductor when no variation in load is applied.

15. An image forming apparatus which superimposes multiple color images on each other on a photoconductor by rotating the photoconductor and a latent image forming part and forms a color image, comprising:

a detecting part which detects a phase difference between a timing of forming a latent image on the photoconductor and a rotational speed of the photoconductor;

a phase correcting part which corrects the phase difference by increasing or decreasing a rotational speed of the latent image forming part on the basis of a detection result provided by the detecting part, while no latent image is being formed on the photoconductor;

a misregistration correcting part which corrects, by using the phase correcting part, a latent image forming misregistration caused by a variation in load acting on the photoconductor when a latent image of each of the multiple color images is to be formed on the photoconductor, said variation in load detected by a load variation detecting part; and wherein the latent image forming misregistration caused by the variation in load acting on the photoconductor is calculated from a difference between the rotational period of the photoconductor when a variation in load is applied thereto and the rotational period of the photoconductor when no variation in load is applied thereto.

16. An image forming apparatus which superimposes multiple color images on each other on an intermediate transfer medium by rotating a photoconductor and the intermediate transfer medium by a driving source using identical or different driving signals and forms a color image, comprising:

a calculation part which calculates a transfer misregistration caused by a variation in load acting on the intermediate transfer medium from a difference between a rotational period of the intermediate transfer medium when a variation in load is applied thereto and a rotational period of the intermediate transfer medium when no variation in load is applied thereto; and a misregistration correcting part which corrects the transfer misregistration on the basis of a calculation result provided by the calculation part.

* * * * *